US009656465B2

(12) United States Patent
Yokozawa et al.

(10) Patent No.: US 9,656,465 B2
(45) Date of Patent: May 23, 2017

(54) INK JET PRINTING APPARATUS AND INK JET PRINTING METHOD

(71) Applicant: CANON KABUSHIKI KAISHA, Tokyo (JP)

(72) Inventors: Taku Yokozawa, Yokohama (JP); Hiroaki Shirakawa, Kawasaki (JP); Mitsutoshi Nagamura, Tokyo (JP); Yuhei Oikawa, Yokohama (JP); Yosuke Ishii, Kawasaki (JP); Hiroaki Komatsu, Fuji (JP); Satoshi Azuma, Kawasaki (JP); Hiroshi Taira, Fuchu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/059,118

(22) Filed: Mar. 2, 2016

(65) Prior Publication Data

US 2016/0257114 A1 Sep. 8, 2016

(30) Foreign Application Priority Data

Mar. 5, 2015 (JP) ..... 2015-044054

(51) Int. Cl.
*B41J 2/045* (2006.01)

(52) U.S. Cl.
CPC ..... *B41J 2/04563* (2013.01); *B41J 2/0458* (2013.01); *B41J 2/04551* (2013.01)

(58) Field of Classification Search
CPC ... B41J 2/04563; B41J 2/04551; B41J 2/0458
See application file for complete search history.

(56) References Cited

U.S. PATENT DOCUMENTS

2008/0303853 A1* 12/2008 Woods ..... B41J 2/04563 347/17
2011/0261104 A1 10/2011 Tatsumi
2012/0194587 A1 8/2012 Teshigawara et al.
2012/0212533 A1* 8/2012 Yoshimoto ..... B41J 2/04553 347/14
2013/0093809 A1* 4/2013 Kosaka ..... B41J 2/04528 347/10
2013/0120484 A1 5/2013 Yasutani
2013/0176357 A1* 7/2013 Yasutani ..... B41J 2/0454 347/17
2013/0257944 A1 10/2013 Yasutani
2015/0343817 A1* 12/2015 Yokozawa ..... B41J 2/0454 347/17

FOREIGN PATENT DOCUMENTS

JP 5-31905 A 2/1993
JP 2002-240252 A 8/2002
JP 2008-195027 A 8/2008

* cited by examiner

*Primary Examiner* — Julian Huffman
(74) *Attorney, Agent, or Firm* — Canon U.S.A., Inc. IP Division

(57) ABSTRACT

A recording apparatus is capable of executing multiple types of different temperature control. A recording head of the recording apparatus has multiple temperature sensors disposed at different positions from each other in the recording head. Each of the multiple types of different temperature control is performed based on representative temperatures acquired using different combinations of the temperature sensors.

32 Claims, 21 Drawing Sheets

FIG. 7A
| DRIVE PULSE No.[N] | DRIVE PULSE WAVEFORM |
|---|---|
| No.6 | 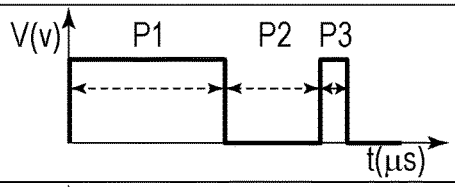  P1: 0.48 μs<br>P2: 0.30 μs<br>P3: 0.08 μs |
| No.5 | 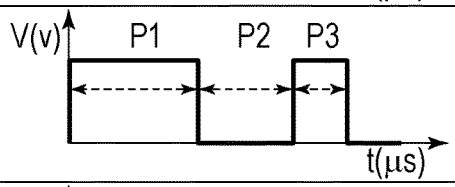  P1: 0.40 μs<br>P2: 0.30 μs<br>P3: 0.16 μs |
| No.4 | 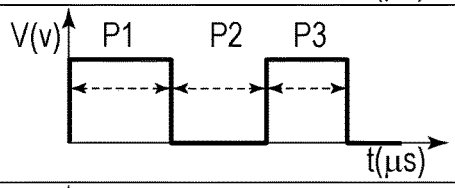  P1: 0.32 μs<br>P2: 0.30 μs<br>P3: 0.24 μs |
| No.3 | 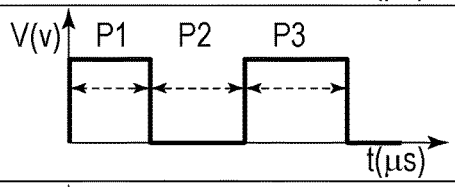  P1: 0.24 μs<br>P2: 0.30 μs<br>P3: 0.32 μs |
| No.2 | 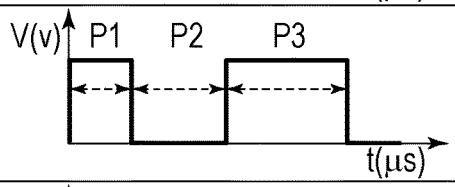  P1: 0.16 μs<br>P2: 0.30 μs<br>P3: 0.40 μs |
| No.1 | 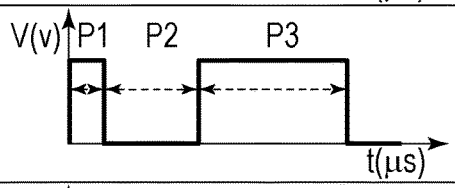  P1: 0.08 μs<br>P2: 0.30 μs<br>P3: 0.48 μs |
| No.0 | 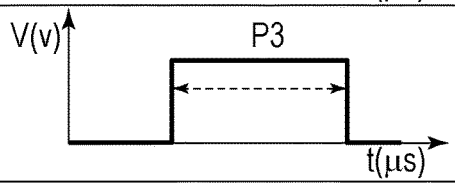  P1: 0 μs<br>P2: 0 μs<br>P3: 0.56 μs |
FIG. 7B
| INK TEMPERATURE | < 20C° | ≥ 20C°, < 30C° | ≥ 30C°, < 40C° | ≥ 40C°, < 50C° | ≥ 50C°, < 60C° | ≥ 60C°, < 70C° | ≥ 70C° |
|---|---|---|---|---|---|---|---|
| DRIVE PULSE | No.6 | No.5 | No.4 | No.3 | No.2 | No.1 | No.0 |

INK JET PRINTING APPARATUS AND INK JET PRINTING METHOD

BACKGROUND OF THE INVENTION

Field of the Invention

The present invention relates to an ink jet printing apparatus and an ink jet printing method.

Description of the Related Art

There is conventionally known an ink jet printing apparatus where a printing head has multiple printing element arrays where multiple printing elements that generate thermal energy to discharge ink are arrayed. The printing head is scanned as to a printing medium while driving the printing elements, thereby discharging ink on the printing medium to print an image.

Performing various types of temperature control regarding the temperature of ink is known in such ink jet printing apparatuses. Japanese Patent Laid-Open No. 5-31905 discloses so-called driving pulse control as an example of temperature control, where driving pulses to be applied to the printing elements are selected according to the temperature of ink, thereby suppressing variance in the amount of ink discharged due to change in ink temperature.

As another example, Japanese Patent Laid-Open No. 2002-240252 discloses performing sub-heater heating control where sub-heaters, different from the printing elements, are provided to the printing head, and are driven when the temperature of the ink is lower than a predetermined threshold value.

On the other hand, Japanese Patent Laid-Open No. 2008-195027 discloses using a printing head having multiple temperature sensors as to a printing element array provided on the same board (heater board). Further, Japanese Patent Laid-Open No. 2008-195027 also discloses calculating the average temperature at multiple temperature sensors as the representative temperature of that printing element array, and selecting driving pulses to be applied to the printing elements within that printing element array, based on the calculated average temperature.

However, in a case where multiple types of temperature control are performed, such as the above case of driving pulse control and sub-heater heating control, as temperature control relating to the temperature of ink in a certain printing element array, using temperature sensors of the same combination, regardless of the type of temperature control, as in Japanese Patent Laid-Open No. 2008-195027, may result in suitable temperature control not being able to be performed.

SUMMARY OF THE INVENTION

It has been found desirable to execute suitable control in each of multiple types of temperature control.

An ink jet printing apparatus according to an aspect of the present invention includes: a printing head having a printing element array, in which a plurality of printing elements configured to generate thermal heat to discharge ink are arrayed in a predetermined direction, and detecting elements configured to detect temperature; an acquisition unit configured to, at a time of performing first temperature control of the printing head, acquires information relating to temperature at a plurality of detecting elements necessary for first temperature control of the printing head, and at a time of performing second temperature control of the printing head, acquires information relating to temperature at a plurality of detecting elements necessary for second temperature control of the printing head; and a control unit configured to perform temperature control of the printing head based on information relating to temperature that has been acquired by the acquisition unit. The plurality of detecting elements necessary for first temperature control of the printing head and the plurality of detecting elements necessary for second temperature control of the printing head partially overlap.

Further features of the present invention will become apparent from the following description of exemplary embodiments with reference to the attached drawings.

BRIEF DESCRIPTION OF THE DRAWINGS

FIGS. 7A and 7B are diagrams for describing driving pulses used in the embodiment.

DESCRIPTION OF THE EMBODIMENTS

First Embodiment

Figure 1:
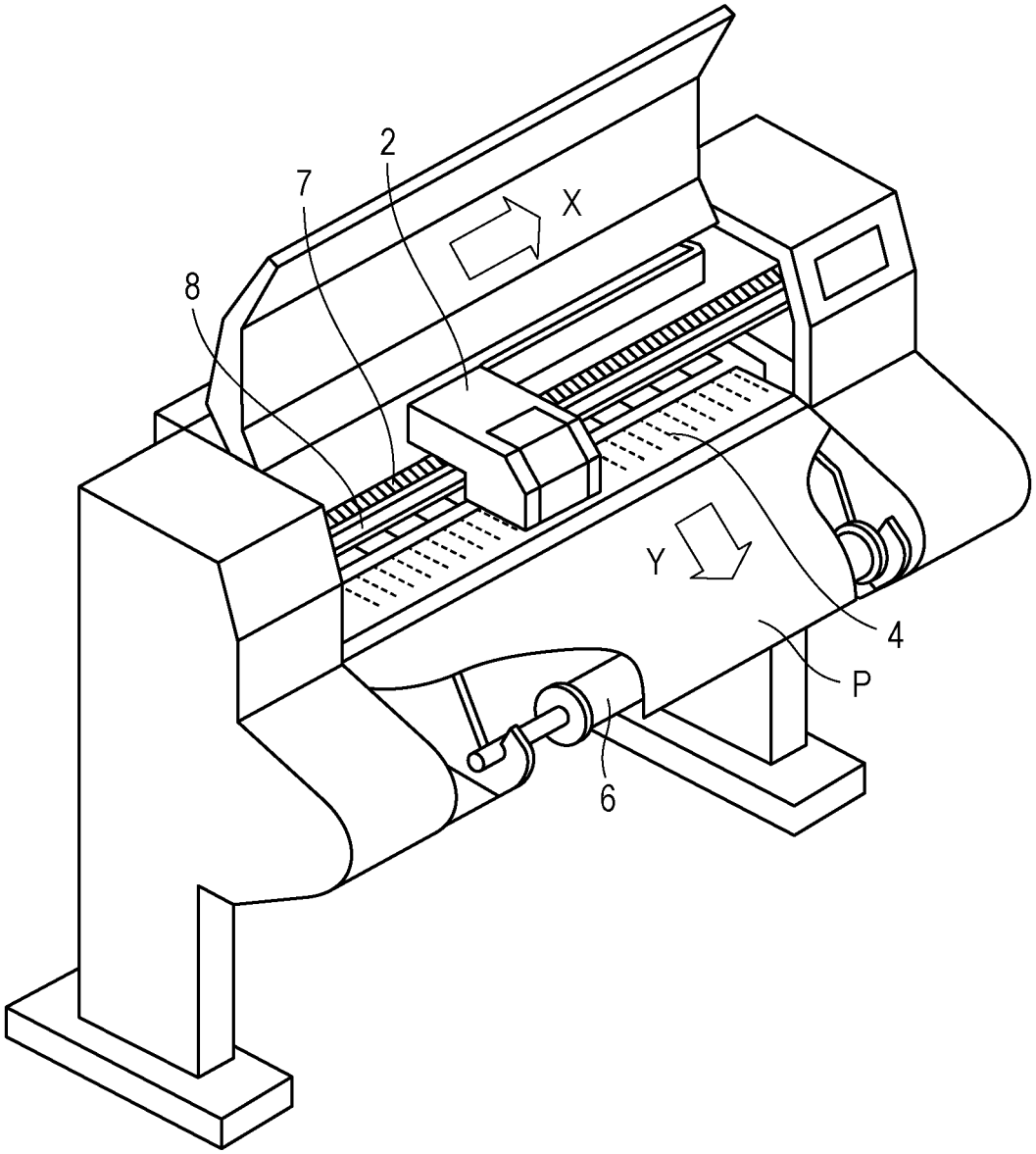
FIG. 1 is a perspective view of an ink jet printing apparatus according to an embodiment.

A first embodiment of the present invention will be described in detail with reference to the drawings. FIG. 1 illustrates an outer appearance of an ink jet printing apparatus (hereinafter, also referred to as "printer") according to the present embodiment. This is a so-called serial scanning printer, that conveys a printing medium P in a conveyance direction (Y direction), and scans a printing head in a cross direction (X direction) orthogonal thereto, to print images.

An overview of this ink jet printing apparatus, and operations when printing, will be described by way of FIG. 1. First, the printing medium P is conveyed in the Y direction from a spool 6 where the printing medium P is held, by a conveyance roller driven via a gear by a conveyance motor, omitted from illustration. On the other hand, a carriage unit 2 is scanned along a guide shaft 8, omitted from illustration, that extends in the X direction at a predetermined conveyance position. A printing head (described later) is detachably mounted to the carriage unit 2. During this scanning, discharging operations are performed from discharging orifices of the printing head at timings based on position signals acquired from an encoder 7, thereby printing a certain bandwidth corresponding to the array range of the discharging orifices. The present embodiment is configured to scan at a scanning speed of 40 inches per second, and perform discharging operations at a resolution of 600 dpi (1/600 inch). Thereafter, the printing medium P is conveyed, and printing is performed for the next bandwidth.

This sort of printer may print images in a unit region by one scan (so-called one-pass printing), or may print images by multiple scans (so-called multi-pass printing). In a case of performing one-pass printing, the printing medium P may be conveyed by an amount equivalent to the bandwidth between each scan. There is a method for a case of performing multi-pass printing, where instead of conveying between each scan, multiple scans are performed on a unit region on the printing medium P, and thereafter the unit region is conveyed by around one band worth. Another method for multi-pass printing is to print data that has been thinned out by a predetermined mask pattern for each scan, then feed the printing medium P by around 1/n band, and perform scanning again. This method completes an image by multiple scans by different nozzles relating to the printing on the unit region on the printing medium P, and conveying.

One end of a flexible printed circuit board (omitted from illustration) for supplying signal pulses for discharging driving, temperature adjustment signals, and so forth, is attached to the printing head. The other end of the flexible printed circuit board is connected to a control circuit (described later) that has control functions of executing control of the printer. The printer also has an internal temperature sensor (omitted from illustration) for detecting internal temperature within the apparatus, nearby the printing head.

A carriage belt may be used for transmitting driving force from a carriage motor to the carriage unit 2. Other driving systems may be used as well, such as an arrangement including a lead screw that extends in the X direction and is rotationally driven by the carriage motor, and an engaging portion that is provided to the carriage unit 2 and engages a groove provided to the lead screw, and so forth, for example.

The printing medium P that is fed is conveyed by being nipped by a sheet feeding roller and a pinch roller, and is guided to a printing position on a platen 4 (main-scan region of printing head). Normally, in an inactive state, the orifice face of the printing head is capped. Accordingly, the cap is opened before printing, so that the printing head and carriage unit 2 can be scanned. Thereafter, one scan worth of data is stored in a buffer, and the carriage motor 3 scans the carriage unit 2 to perform printing as described above.

Figure 2:
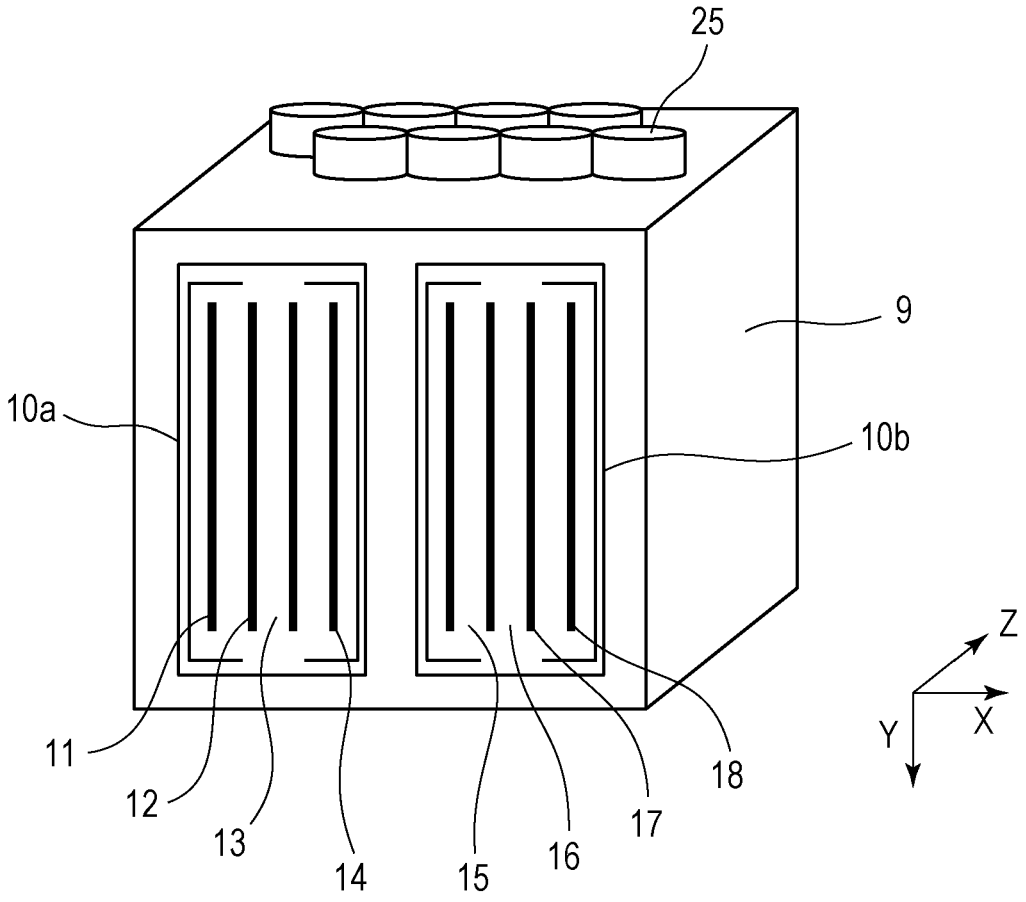
FIG. 2 is a schematic diagram of a printing head according to the embodiment.

FIG. 2 is a perspective view schematically illustrating the printing head 9 according to the present embodiment. A joint portion 25 is formed on the printing head 9, to which ink supply channels, extending from ink tanks (omitted from illustration) disposed at a position away from the printing head 9, are connected. Ink is supplied into the printing head 9 from the ink tanks, via the ink supply channels and joint portion 25.

Attached to an discharging orifice formation face, which is a face of the printing head 9 facing the printing medium P, are two printing element boards, 10*a* and 10*b*, formed of a semiconductor or the like. Discharging orifice arrays are formed on each of the printing element boards 10*a* and 10*b*, extending in the Y direction orthogonal to the X direction. Specifically, an discharging orifice array 11 that discharges black (Bk) ink, an discharging orifice array 12 that discharges gray (Gy) ink, an discharging orifice array 13 that discharges light gray (Lgy) ink, and an discharging orifice array 14 that discharges light cyan (Lc) ink, are disposed arrayed in the X direction on the printing element board 10*a*. An discharging orifice array 15 that discharges cyan (C) ink, an discharging orifice array 16 that discharges light magenta (Lm) ink, an discharging orifice array 17 that discharges magenta (M) ink, and an discharging orifice array 18 that discharges yellow (Y) ink, are disposed arrayed in the X direction on the printing element board 10*b*.

Within the printing element boards 10*a* and 10*b*, at positions facing the discharging orifice arrays 11 through 18, there are formed printing element arrays which will be described later. The printing element arrays at positions facing the discharging orifice arrays 11 through 18 will be referred to as printing element arrays 11*x* through 18*x*, respectively.

Figure 3A:
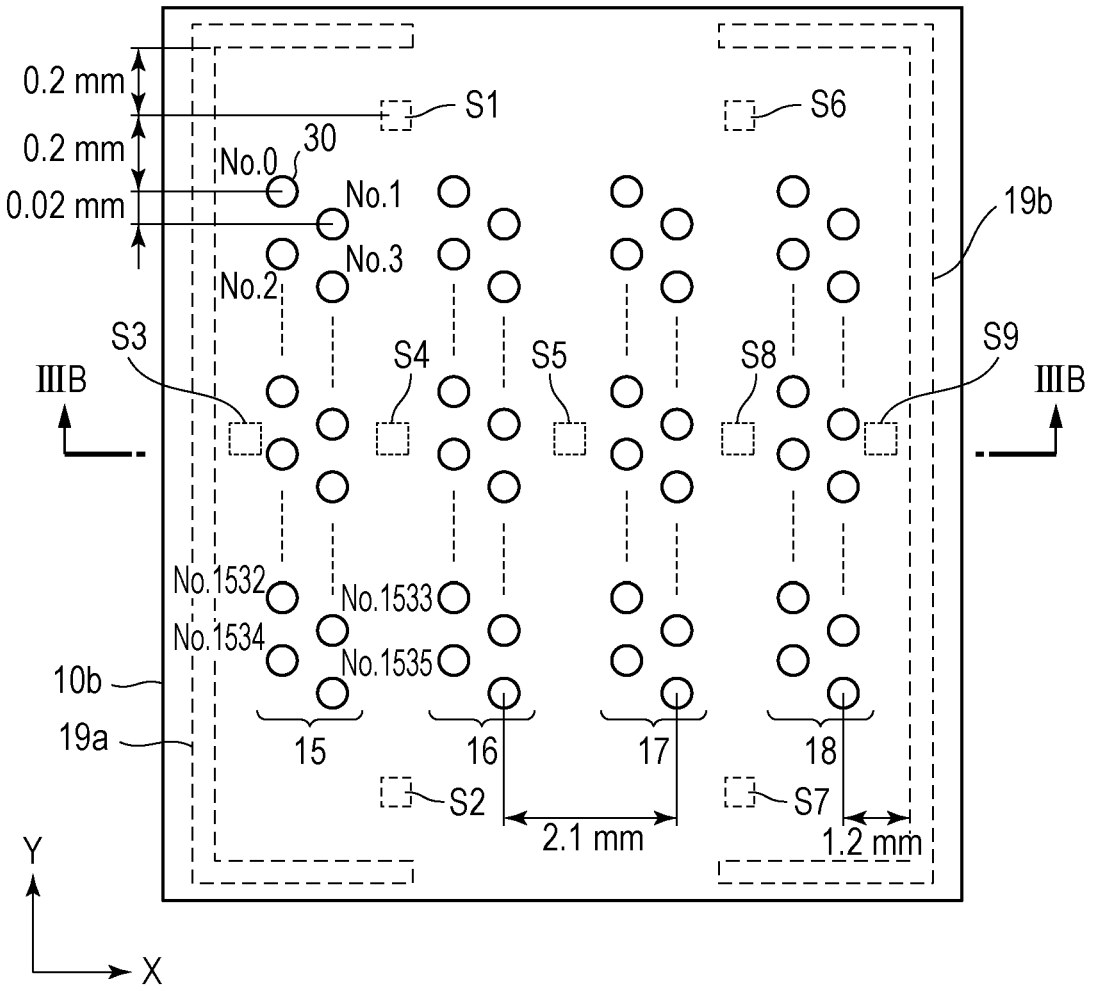
FIGS. 3A and 3B are a plan view and cross-sectional view of a printing head according to the embodiment.
Figure 3B:
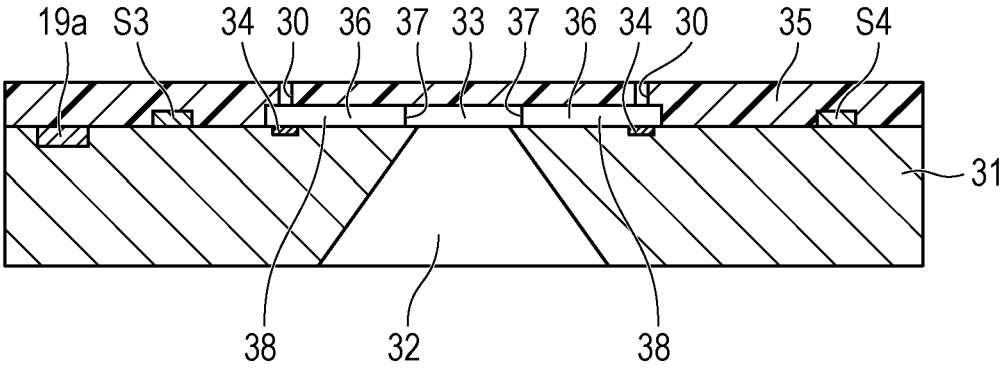

FIG. 3A is a plan view of the printing element board 10*b* as viewed from a direction perpendicular to the X-Y plane. FIG. 3B is a cross-sectional view of the printing element board 10*b* taken perpendicularly along line IIIB-IIIB in FIG. 3A. FIG. 3B illustrates the vicinity of the discharging orifice array 15, as viewed from the downstream side in the Y direction. Note that the dimensional ratio of the parts in FIGS. 3A and 3B have been changed in the illustration for the sake of simplification. The actual size of the printing element board 10*b* is 9.55 mm in the X direction, and 39.0 mm in the Y direction.

The discharging orifice arrays 11 through 18 according to the present embodiment are each formed of two rows. The two rows are offset from each other by one dot at 1200 dpi (dots per inch). Each row has 768 discharging orifices 30 arrayed on the Y direction (array direction) for a total of 1536 discharging orifices 30, and the same number of printing elements 34 which are electrothermal conversion elements arrayed in the Y direction (predetermined direction), each printing element 34 facing an discharging orifice 30. 1200 dpi in the present embodiment is equivalent to 0.02 mm. Thermal energy for discharging ink from the discharging orifices 30 can be generated by applying pulses to the printing elements 34 in accordance with image data. Although an example of electrothermal conversion elements as been described for the printing elements 34, piezoelectric transducers or the like may be used. There also are arrangements where so-called dummy nozzles, which do not contribute to discharging of ink, are provided besides the nozzles used for printing images, but description thereof will be omitted here.

A total of nine diode sensors (hereinafter also referred to as "detecting elements" and "temperature sensors") S1 through S9, for detecting the temperature at different positions in the printing element board 10*b*, are formed in the printing element board 10*b*. Of these, two temperature sensors S1 and S6 are disposed near one end of the discharging orifice arrays 15 through 18 in the Y direction. More specifically, the temperature sensors S1 and S6 are disposed at positions 0.2 mm away from discharging orifices 30 at one end in the Y direction. The temperature sensor S1 is disposed between the discharging orifice array 15 and discharging orifice array 16 in the X direction, and temperature sensor S6 is disposed between the discharging orifice array 17 and discharging orifice array 18 in the X direction.

Further, two temperature sensors S2 and S7 are disposed near the other end of the discharging orifice arrays 15 through 18 in the Y direction. The temperature sensor S2 is disposed between the discharging orifice array 15 and discharging orifice array 16 in the X direction, and temperature sensor S7 is disposed between the discharging orifice array 17 and discharging orifice array 18 in the X direction. More specifically, the temperature sensors S2 and S7 are disposed at positions 0.2 mm away from discharging orifices 30 at the other end in the Y direction.

Further, five temperature sensors S3, S4, S5, S8, and S9 are disposed at the middle portion of the discharging orifice arrays 15 through 18 in the Y direction. The temperature sensor S4 is disposed between the discharging orifice array 15 and discharging orifice array 16 in the X direction, the temperature sensor S5 is disposed between the discharging orifice array 16 and discharging orifice array 17 in the X direction, and the temperature sensor S8 is disposed between the discharging orifice array 17 and discharging orifice array 18 in the X direction. The temperature sensor S3 is disposed on the outer side of the discharging orifice array 15 in the X direction, and temperature sensor S9 is disposed on the outer side of the discharging orifice array 18 in the X direction.

The temperature of ink within discharging orifices 30 near the temperature sensors is generally the same as the temperature of the printing element board 10*b* at the positions where the temperature sensors are disposed, so the temperature of the printing element board 10*b* will be deemed to be the temperature of the ink.

Heating elements (hereinafter also referred to as "sub-heaters") 19*a* and 19*b*, for heating ink within the discharging orifice 30 are provided to the printing element board 10*b*. The heating element 19*a* is formed as a single continuous member so as to cover the side of the discharging orifice array 15 on which the temperature sensor S3 is disposed. In the same way, the heating element 19*b* is formed as a single continuous member so as to cover the side of the discharging orifice array 18 on which the temperature sensor S9 is disposed. The heating elements 19*a* and 19*b* are situated 1.2 mm on the outer side from the discharging orifice arrays 15 and 18 in the X direction, and 0.2 mm on the outer side from the temperature sensors S1, S2, S6, and S7 in the Y direction.

In addition to the temperature sensors S1 through S9 and the sub-heaters 19*a* and 19*b*, the printing element board 10*b* includes a board 31 in which various circuits are formed, and a discharging orifice material 35 formed of resin. A common ink chamber 33 is formed between the board 31 and the discharging orifice material 35, and an ink supply port 32 communicates with the common ink chamber 33. An ink channel 36 extends from the common ink chamber 33, with a bubble generating chamber 38 formed at the end of the ink channel 36 toward the discharging orifice 30. A printing element (main heater) 34 is disposed in the bubble generating chamber 38, at a position facing the discharging orifice 30. A nozzle filter 37 is formed between the ink channel 36 and the common ink chamber 33.

Even if heat is uniformly applied to the printing head applied in the present embodiment by short pulses, the ink temperature at the middle portion in the Y direction tends to rise more readily than the ink temperature at the end portions in the Y direction. This is thought to be due to the fact that there are heated regions (regions where printing elements 34 are formed) on both sides at the middle portion in the Y direction of the printing element board 10*b*, while at the end portions in the Y direction there are non-heated regions (regions where no printing element 34 are formed), so heat more readily escapes to the non-heated regions. Further, in cases where a bonding member (omitted from illustration) bonded to the lower face of the board 31 illustrated in FIG. 3B is formed of alumina or stainless steel with high thermal capacity, it is though that heat dissipation to the atmosphere also occurs through the bonding member. Although detailed description has been made here with regard to the printing element board 10*b*, the printing element board 10*a* also has approximately the same configuration.

Figure 4:
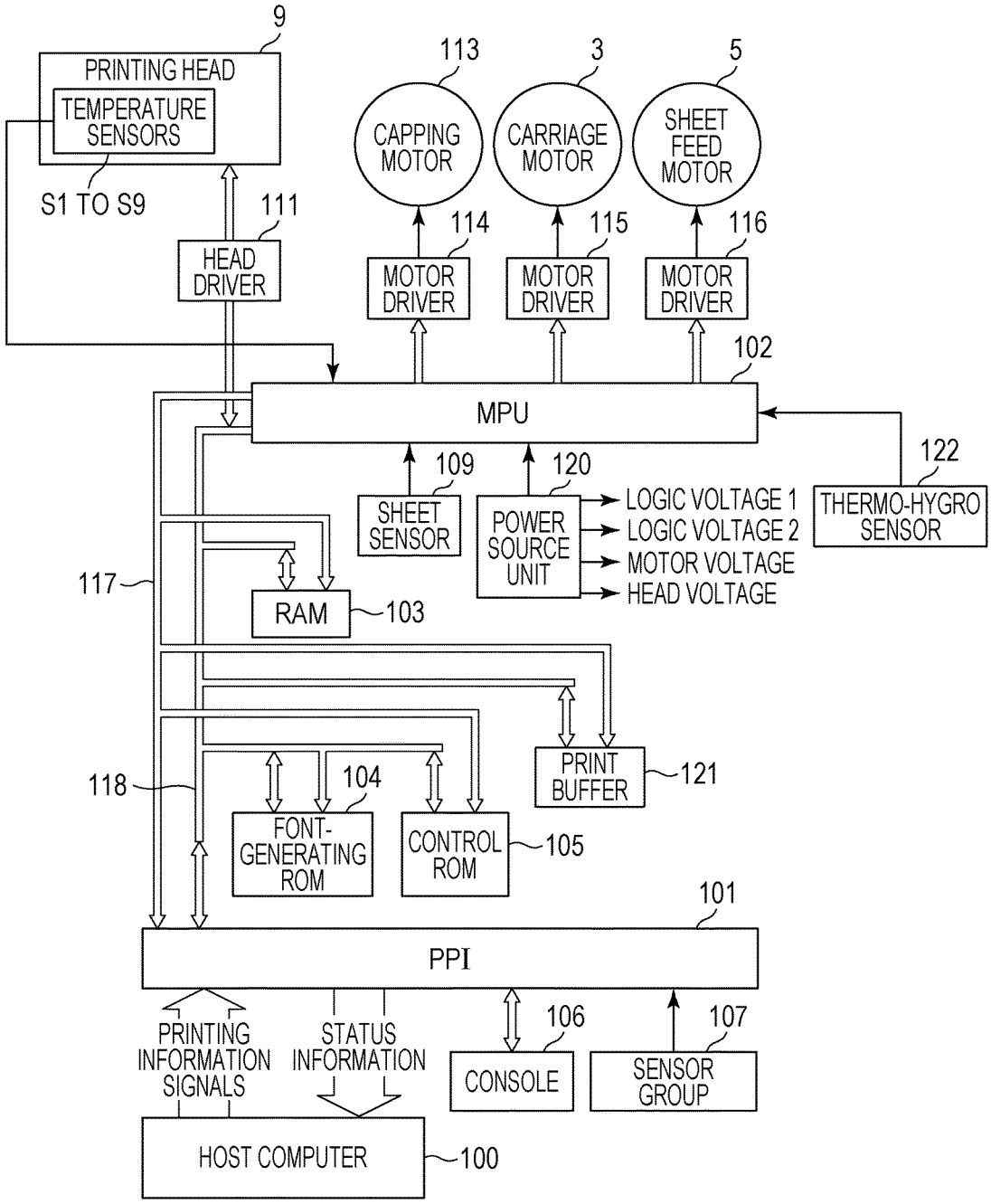
FIG. 4 is a diagram illustrating a printing control system according to the embodiment.

FIG. 4 illustrates a configuration example of the control circuit of the ink jet printing apparatus, used in the present embodiment. In FIG. 4, reference numeral 101 denotes a programmable peripheral interface (hereinafter "PPI") that receives printing information signals including instruction signals (commands) and printing data transmitted from a host computer 100, and transmits the printing information signals to a microprocessor unit (MPU) 102. The PPI 101 also transmits status information of the printer to the host computer 100 as necessary. The PPI 101 further exchanges information with a console 106 that has a settings input unit, a display unit, and so forth, that a user uses to perform various types of settings regarding the printer, and receives input signals from a sensor group 107 including a home position sensor that detects whether the carriage unit 2 and printing head 9 are at a home position, a capping sensor, and so forth.

The MPU 102 controls the parts within the printer following control programs stored in control read-only memory (ROM) 105. Reference numeral 103 denotes random access memory (RAM) that stores received signals, and also is used as a work area for the MPU 102 and temporarily stores various types of data. Reference numeral 104 denotes font-generating ROM that stores pattern information for characters and the like corresponding to code information, and outputs various types of pattern information in accordance with input code information. Reference numeral 121 denotes a print buffer that stores printing data loaded to the RAM 103 or the like, having capacity for several lines worth of printing. The control ROM 105 can store, in addition to the aforementioned control programs, fixed data corresponding to program data (e.g., data for the MPU to decide the starting timing for sub-heater control, which is a principal part of the present embodiment) used in the process of later-described control, and so forth. These parts are controlled by the MPU 102 via an address bus 117 and data bus 118. The MPU 102 acquires information of temperatures detected by the temperature sensors S1 through S9 disposed in the printing head 9, and generates the above-described program data based on the temperature information.

Reference numerals 114, 115, and 116 denote motor drivers that respectively drive a capping motor 113, a carriage motor 3, and a sheet feeding motor 5, under control of the MPU 102.

Reference numeral 109 denotes a sheet sensor that detects whether or not a printing medium is present, i.e., whether or not a printing medium P has been fed to a position where the printing head 9 can perform printing. Reference numeral 111 denotes a head driver that drives the heat-generating portions of the printing head 9 (main heaters and sub-heaters) in accordance with the above-described program data. Reference numeral 122 denotes a thermo-hygro sensor 122 that detects the environment temperature and environment humidity in the environment where the printer proper is installed. Reference numeral 120 denotes a power source unit that supplies electric power to the above-described parts, having an AC adapter and battery serving as a driving power supply device.

When transmitting printing data from the host computer 100 via parallel port, infrared port, network, or the like, in the printing system including the above-described printer and the host computer 100 that supplies printing information signals to the printer, necessary commands are attached to the header of the printing data. Examples of the commands include the type of printing media on which printing is to be performed (plain paper, overhead projector (OHP) sheets, glossy paper, and further types of special printing media such as transfer film, cardboard, banner sheets, and so forth), media size (A0 size, A1 size, A2 size, B0 size, B1 size, B2 size, and so forth), printing quality (draft, high-quality, medium quality, enhancement of a particular color, whether monochrome or color, and so forth), sheet feed path (determined according to the forms and types of sheet feeding arrangements that the printer has, such as automatic sheet feeder (ASF), manual sheet feed, sheet feeding cassette 1, sheet feeding cassette 2, and so forth), and whether or not to automatically distinguish objects. In a case where is a configuration is employed that applies a treatment liquid to improve fixability of the ink on the printing medium, information to decide whether or not to apply the treatment liquid may be transmitted as a command.

Data necessary to perform printing is read out from the above control ROM 105 at the printer side, in accordance with these commands, and printing is performed based on this data. Examples of data include the number of printing passes when performing the above-described multi-pass printing, the discharging amount of ink per unit area of the printing medium and the printing direction, and so forth. Further examples include the type of mask used for thinning out data that is applied when performing multi-pass printing, driving conditions of the printing head 9 (e.g., shape of driving pulses to be applied to the heat-generating portions, duration, and so forth), dot size, conditions of printing medium conveyance, number of colors used, carriage speed, and so forth.

The ink jet printing apparatus according to the present embodiment executes multiple types of temperature control in accordance with the temperature of the ink. More specifically, four types of temperature control are performed, namely, driving pulse control, sub-heater heating control, overheating protection control, and short-pulse heating control, each of which is described later.

1. Driving Pulse Control

The present embodiment performs so-called driving pulse control, where one driving pulse is selected from multiple driving pulses in accordance with ink temperature while scanning the printing head 9. The selected driving pulse is applied to the printing elements 34 thereby heating the printing elements 34, and the generated thermal energy is used to discharge the ink.

The driving pulse control according to the present embodiment uses a representative temperature for each printing element array, acquired based on the temperature detected by the multiple temperature sensors S1 through S9 for each printing element array. The method of acquiring the representative temperature will be described later.

Note that a so-called double pulse, made up of a pre-pulse and a main pulse, is used as the driving pulse to be applied in the present embodiment.

Figure 5:
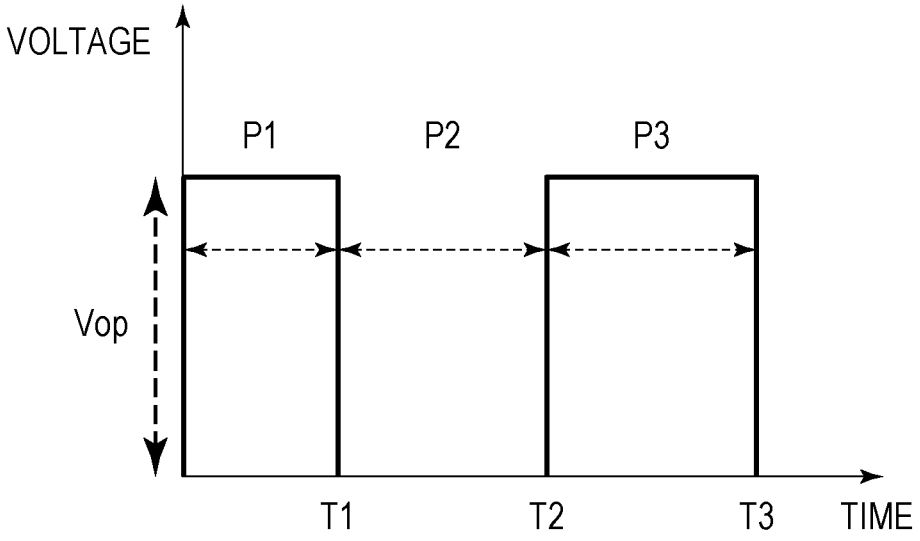
FIG. 5 is a schematic diagram for describing driving pulses.

FIG. 5 is a drawing to describe the aforementioned double pulse. In FIG. 5, Vop represents driving voltage, P1 represents pre-pulse pulse width, P2 represents interval time, and P3 represents main-pulse pulse width. Discharging control of ink is performed by controlling the pulse width of the pre-pulse, so the pre-pulse plays an important role.

The pre-pulse is primarily a pulse applied to heat the ink nearby the printing element 34, to facility bubbling. The pulse width of the pre-pulse is set to a value that will obtain an energy smaller than an energy value at the boundary where the ink bubbles.

The interval time is a certain width of time provided between the pre-pulse and the main pulse, and is set to a time where the heat generated by application of the pre-pulse is sufficiently transmitted to the ink nearby the printing element 34. The main pulse is a pulse used to cause the ink to bubble, and discharge ink droplets.

Figure 6A:
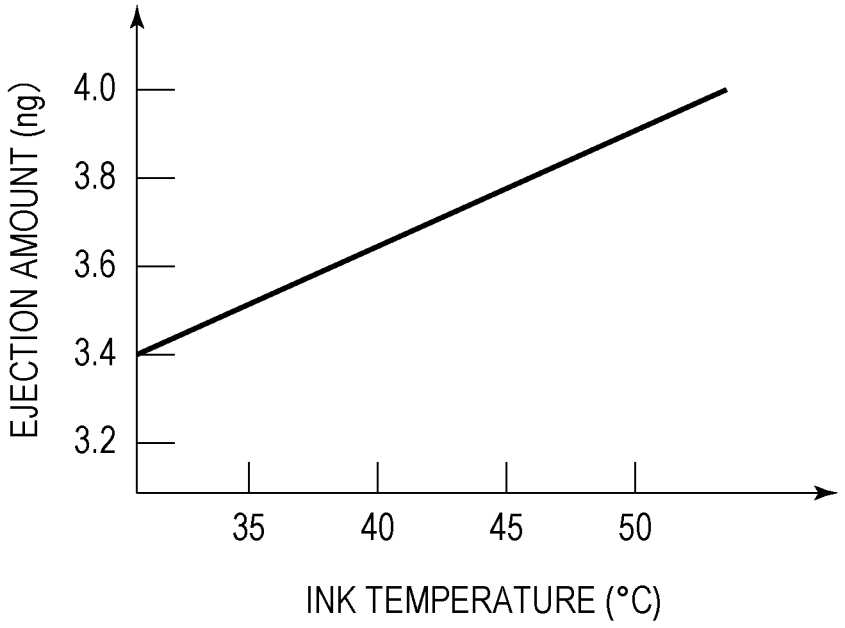
FIGS. 6A and 6B are diagrams for describing correlation between ink temperature, driving pulses, and amount of ink discharged.

FIG. 6A is a diagram illustration the relationship between the ink temperature and ink discharging amount in a case where the waveform of driving pulses applied to the printing element 34 and the driving voltage Vop are fixed. It can be seen that the higher the ink temperature is, the more ink is discharged.

Figure 6B:
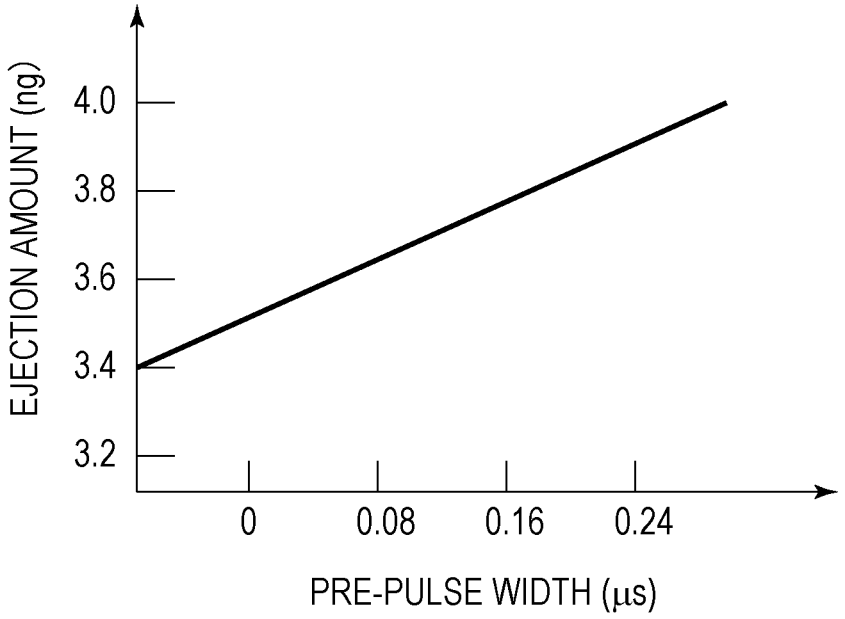

On the other hand, FIG. 6B is a diagram illustrating the relationship between the pre-pulse pulse width and the ink discharging amount under conditions where the temperature of the ink is the same, and the interval time and driving voltage Vop are fixed. It can be seen from here that increasing the pre-pulse pulse width P1 results in a proportionate increase in ink discharge amount Vd. The ink temperature rises as the pre-pulse pulse width P1 becomes larger and the amount of energy that the pre-pulse imparts increases, and accordingly the viscosity of the ink decreases. Applying the main pulse in a state where the viscosity of the ink has dropped means that the amount of ink discharged will increase. Conversely, applying the main pulse in a state where the viscosity of the ink has not dropped much means that the amount of ink discharged will decrease.

Accordingly, fluctuation in ink discharge amount owing to change in board temperature (ink temperature) is suppressed in the present embodiment by changing the pre-pulse pulse width in accordance with ink temperature. Specifically, in a case where the ink temperature is relatively low, the ink discharge amount may drop, so the pre-pulse pulse width P1 of the driving pulse applied to the printing element 34 is increased relatively. Accordingly, the ink discharge amount can be kept from dropping. In the same way, in a case where the ink temperature is relatively high, the pre-pulse pulse width P1 of the driving pulse applied to the printing element 34 is decreased relatively.

FIG. 7A is a diagram illustrating waveforms of driving pulses that are applicable in the present embodiment. All seven of the driving pulses No. 0 through No. 6 applicable in the present embodiment have the same driving voltage. Driving pulses No. 1 through No. 6 also each have the same interval time P2 (P2=0.30 μs). Driving pulse No. 0 has no pre-pulse (P1=0 μs), and is a so-called single pulse. On the other hand, the driving pulses No. 0 through No. 6 are set so that the pre-pulse pulse width P1 and main-pulse pulse width P3 are different from each other. Specifically, the driving pulse No. 0 is set having the smallest pre-pulse pulse width P1 (P1=0 μs) of the seven driving pulses, while the main-pulse pulse width P3 is the largest (P3=0.56 μs).

Next, the driving pulse No. 1 is set having the pre-pulse pulse width P1 increased by 0.08 μs as compared to the driving pulse No. 0 (P1=0.08 μs), while the main-pulse pulse width P3 is reduced by 0.08 μs (P3=0.48 μs). Thereafter, the pre-pulse pulse width P1 is increased by 0.08 μs increments as the number of the driving pulse ascends, and also the main-pulse pulse width P3 is reduced by 0.08 μs increments. The driving pulse No. 6, which has the largest number of the seven driving pulses is set so that the pre-pulse pulse width P1 is the largest of the seven driving pulses (P1=0.48 μs), and the main-pulse pulse width P3 is the smallest (P3=0.08 μs).

The larger then pre-pulse pulse width P1 is, the larger the ink discharge amount is, as illustrated in FIG. 6B. Accordingly, in a case where the driving pulses No. 1 through No. 6 applicable in the present embodiment are applied to printing elements 34 under conditions that the ink temperature is the same for all, the ink discharge amount is the smallest in the case of applying driving pulse No. 0, and the ink discharge amount Vd is the largest in the case of applying driving pulse No. 6. Also, the pre-pulse pulse width of the driving pulses No. 0 through No. 6 increases in equal intervals of 0.08 μs increments as the number ascends, so the ink discharge amount increases in approximately the same amount as the number of the driving pulse ascends.

FIG. 7B is a table illustrating the relationship between the ink temperature and the driving pulses actually applied to the printing element 34. As described above, the higher the ink temperature is, the larger the ink discharge amount is. In order to suppress fluctuation in ink discharge amount owing to change in ink temperature, the higher the ink temperature is, the smaller the pre-pulse pulse width P1 of the driving pulse selected to be applied in the present embodiment is.

For example, in a case where the ink temperature is lower than 20° C., which is relatively low, driving pulse No. 6 which has a relatively large pre-pulse pulse width P1 is selected from those illustrated in FIG. 7A. On the other hand, in a case where the ink temperature is higher than 70° C., which is relatively high, driving pulse No. 0 which has a relatively small pre-pulse pulse width P1 is selected from those illustrated in FIG. 7A.

Figure 8:
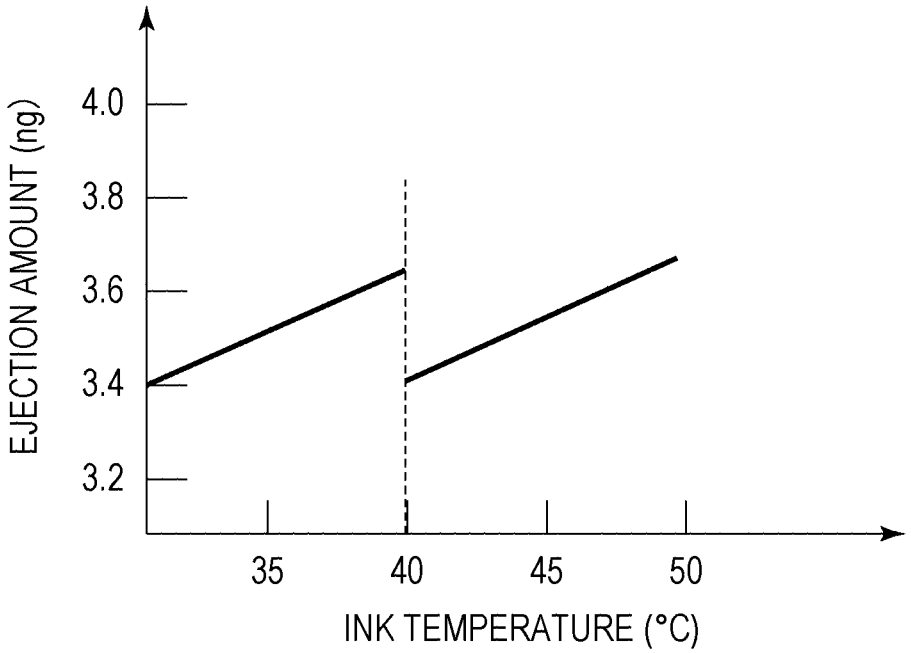
FIG. 8 is a diagram for describing correlation between temperature at a time of having performed driving pulse control, and the amount of ink discharged.

FIG. 8 is a diagram illustrating the correlation between ink temperature and ink discharge amount in a case where driving pulse are selected and applied, as illustrated in FIG. 7A and 7B. Of the temperature range illustrated in FIG. 8, driving pulse No. 4 is selected and applied to the printing element 34 as shown in FIG. 7B from 30° C. to 40° C. During this time, the ink discharge amount continues to rise as the ink temperature rises, in the same way as illustrated in FIG. 6A. When the ink temperature exceeds 40° C., the driving pulse is changed to the driving pulse No. 3 that has a shorter pre-pulse pulse width than the driving pulse No. 4. Accordingly, the ink discharge amount can be reduced, as illustrated in FIG. 8. Thus, performing pulse-width modulation (PWM) control enables fluctuation in ink discharge amount owing to change in ink temperature to be suppressed while printing, even if the ink temperature has changed.

First Representative Temperature Acquisition Method

In the present embodiment, multiple temperature detection values are selected for each printing element array from the nine temperature detection values detected by the multiple temperature sensors S1 through S9, and a representative temperature for performing driving pulse control at each printing element array is acquired based on the temperature detection values. This processing will be described below in detail.

Temperature detection values (temperature information) from four temperature sensors near to and surrounding one printing element array are used to acquire a representative temperature (hereinafter, also referred to as "first representative temperature") for performing driving pulse control at that printing element array. Table 1 shown below lists the temperature sensors to use for acquiring the representative temperature for performing driving pulse control at each printing element array.

TABLE 1

| | Sensors used |
|---|---|
| Printing element array 15x | S1, S2, S3, S4 |
| Printing element array 16x | S1, S2, S4, S5 |
| Printing element array 17x | S5, S6, S7, S8 |
| Printing element array 18x | S6, S7, S8, S9 |

At the time of acquiring the representative temperature for performing driving pulse control when printing at the printing element array 15*x*, the temperature sensor S1 (first detecting element) which is the closer of the temperature sensors S1 and S6 at the one end in the Y direction of the printing element array 15*x* is used. In the same way, the temperature sensor S2 (second detecting element) which is the closer of the temperature sensors S2 and S7 at the other end in the Y direction of the printing element array 15' (see FIG. 14A) is used. Further, the temperature sensors S3 (third detecting element) and S4 (fourth detecting element) which are the closer of the temperature sensors S3, S4, S5, S8, and S9 at positions corresponding to the middle portion in the Y direction of the printing element array 15*x* are used. Thus, at the time of acquiring the representative temperature for performing driving pulse control when printing at the printing element array 15*x*, the temperature sensors S1, S2, S3, and S4 which surround the printing element array 15*x* are selected. On the other hands, the temperature sensors S5, S6, S7, S8 and S9 (fifth detecting elements), which are more distantly positioned from the printing element array 15*x* than the temperature sensors S1, S2, S3 and S4, are not selected. Temperature sensors used to acquire the representative temperature for performing driving pulse control are selected for the other printing element arrays 16*c*, 17*c*, and 18*c*, in the same way as with the printing element array 15*x* as shown in Table 1.

As can be seen from Table 1, the temperature sensor S2 is disposed at a position close to both printing element arrays 15*x* and 16*x*, and accordingly is used to acquire the representative temperature both when performing driving pulse control of the printing element array 15*x* and when performing driving pulse control of the printing element array 16*x*. In the same way, the temperature sensors S5 and S8 also are used both when performing driving pulse control of two printing element arrays. Accordingly, suitable driving pulse control can be executed even without using a printing head having multiple temperature sensors provided corresponding to each printing element array. Further, increase in size of the printing element board can be suppressed.

Further, in the present embodiment, running average processing is performed regarding temperatures detected five times by four temperature sensors per printing element array, at shorter time intervals, thereby calculating the average temperature at each temperature sensor.

Now, there are cases where the ink temperature differs depending on the position of printing elements in the printing element array. For example, in a case where the ink temperature is relatively high nearby the printing elements (No. 1532 through 1535) at the other end in the Y direction of the printing element array 15*x*, and the ink temperature is low nearby other printing elements, performing driving pulse control using only the average temperature at the temperature sensor S1 may result in the ink discharging amount being excessive at printing elements at the other end in the Y direction.

Accordingly, the average value of the four average temperatures at four temperature sensors per printing element array is calculated in the present embodiment, thereby calculating the representative temperature at that printing element array. For example, in a case where the average temperature at the temperature sensor S1 is 30° C., the average temperature at the temperature sensor S2 is 40° C., the average temperature at the temperature sensor S3 is 50° C., and the average temperature at the temperature sensor S4 is 60° C., the representative temperature at the printing element array 15*x* is calculated by (30+40+50+60)/4=45° C.

Using the average of temperature at each position in each printing element array to calculate a representative temperature, and executing driving pulse control based on the representative temperature calculated this way enables excessive or inefficient discharge from printing elements at positions where the ink temperature is relatively high or relatively low to be suppressed. Although description has been made here regarding the printing element board 10*b* having the printing element arrays 15*x* through 18*x*, the representative temperatures when performing driving pulse control at each of the printing element arrays 11*x* through 14*x* are acquired by the processing performed in the same way for the printing element board 10*a* having the printing element arrays 11*x* through 14*x*, as well.

Driving Pulse Control Based on Representative Temperature

Figure 9:
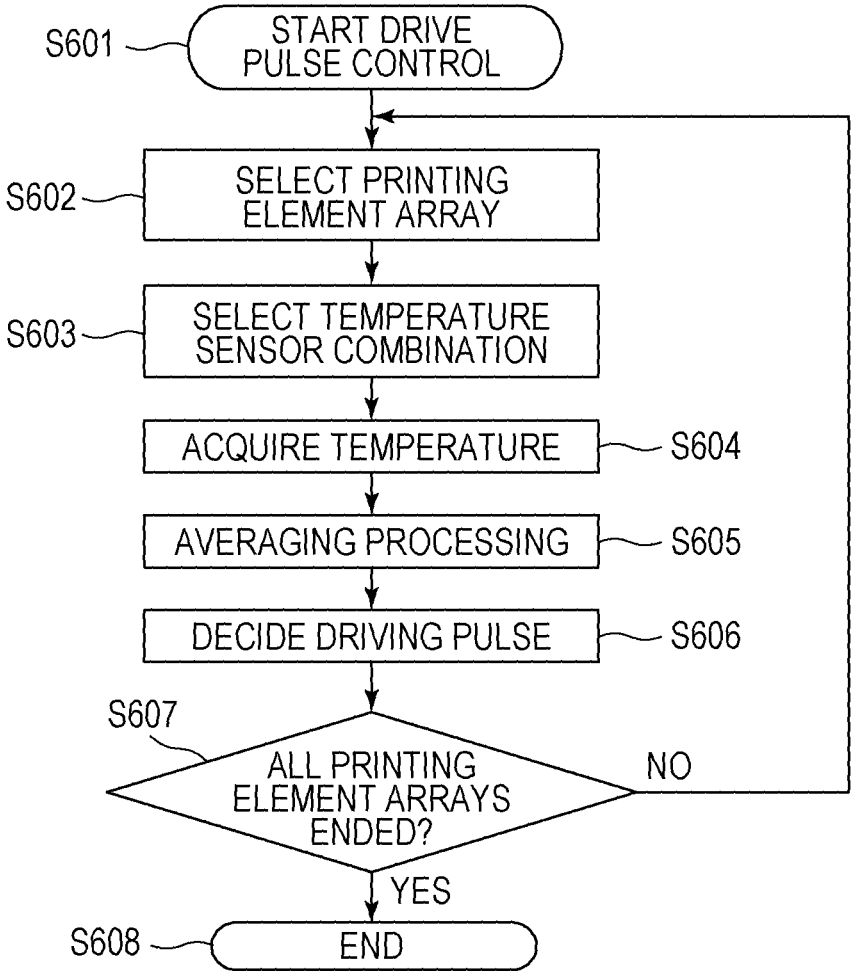
FIG. 9 is a flowchart for describing driving pulse control in the embodiment.

The driving pulse control based on representative temperature according to the present embodiment will be described in detail. FIG. 9 is a flowchart illustrating the process of representative temperature acquisition processing when performing driving pulse control, and driving pulse control processing.

The driving pulse control in FIG. 9 is performed every 5 ms while printing an image. Upon the driving pulse control starting (step S601), one printing element array is selected from the printing element arrays 11*x* through 18*x* (step S602).

Next, a combination of temperature sensors to use to acquire the representative temperature for the selected printing element array is selected (step S603). In a case where the printing element array 16*x* has been selected in step S602 for example, the temperature sensors S1, S2, S4, and S5 are selected in step S603 based on Table 1.

Of the detected temperature values stored in the RAM 103 detected by the temperature sensors S1 through S9, the detected temperature values corresponding to the combination of temperature sensors selected in step S603 are then acquired (step S604). The temperature detection values from the temperature sensors are constantly updated in real-time to the newest values in the RAM 103.

The above-described averaging processing then is performed on the detected temperature values acquired in step S604, and a representative temperature for when performing driving pulse control is calculated (step S605).

Next, a driving pulse to be applied to the printing elements 34 is decided from the multiple driving pulses No. 0 through No. 6 shown in FIG. 7A that are stored in the control ROM 105, based on the representative temperature for performing driving pulse control, calculated in step S605 (step S606).

Thereafter, determination is performed whether the driving pulse deciding processing has been executed on all printing element arrays 11*x* through 18*x* (step S607). In a case where determination is made that there is still a printing element array regarding which the driving pulse deciding processing has not been executed, the flow returns to step S602, and the same processing is performed regarding another printing element array. In a case where the driving pulse deciding processing has been executed on all printing element arrays, the driving pulse control is ended, and the decided driving pulse is applied to the printing element arrays 11*x* through 18*x* and printing is continued.

2. Sub-Heater Heating Control

So-called sub-heater heating control, where the sub-heaters 19*a* and 19*b* are driven in accordance with the temperature of ink during printing, is performed in the present embodiment. This heats the ink near the printing elements to keep warm the ink while printing.

For the ink temperature, the sub-heater heating control according to the present embodiment uses the representative temperature for each sub-heater, acquired based on the temperature detected by the multiple temperature sensors S1 through S9 for each sub-heater. The representative temperature acquisition method will be described later.

In a case where the ink temperature is low while printing, drop in ink discharge amount when discharging ink by applying driving pulses, or other such trouble, may occur. Accordingly, in the sub-heater heating control according to the present embodiment, heating by the sub-heaters is started when the ink temperature is lower than a predetermined threshold temperature, and the heating by the sub-heaters is stopped when the ink temperature reaches or exceeds the threshold temperature. The threshold temperature is 40° C. in the present embodiment.

The temperature of ink during printing can be kept above 40° C. by performing such sub-heater heating control. this enables drop in discharge amount due to lower ink temperature to be suppressed.

Second Representative Temperature Acquisition Method

In the present embodiment, multiple temperature detection values are selected for each sub-heater from the nine temperature detection values detected by the multiple temperature sensors S1 through S9, and a representative temperature for performing sub-heater heating control at each sub-heater is acquired based on the multiple temperature detection values. This processing will be described below in detail.

Temperature detection values (temperature information) from three temperature sensors that are near to one sub-heater and also are at a surrounded position are used to acquire a representative temperature (hereinafter, also referred to as "second representative temperature") for performing sub-heater heating control at that sub-heater. Table 2 shown below lists the temperature sensors to use for acquiring the representative temperature for performing driving pulse control at each sub-heater.

TABLE 2

| | Sensors used |
|---|---|
| Sub-heater 19a | S1, S2, S3 |
| Sub-heater 19b | S6, S7, S9 |

For example, when acquiring a representative temperature for performing sub-heater heating control of the sub-heater 19*a*, the temperature sensor S1 that is at a position closer to the sub-heater 19*a* is used out of the temperature sensors S1 and S6 at the one end side in the Y direction. In the same way, the temperature sensor S2 that is at a closer position is used out of the temperature sensors S2 and S7 at the other end side in the Y direction. Further, the temperature sensor S3 that is at the closest position of the temperature sensors S3, S4, S5, S8, and S9 at positions corresponding to the middle portion in the Y direction of the printing element array 15*x* are used. Thus, at the time of acquiring the representative temperature for performing sub-heater heating control, the temperature sensors S1, S2, and S3, which are surrounded by the sub-heater 19*a* are selected. Temperature sensors used to acquire the representative temperature for performing sub-heater heating control are selected for the sub-heater 19*b* in the same way as with the sub-heater 19*a* as shown in Table 2.

Now, in a case of printing an image where the ink discharge amount from the printing elements (No. 1532 through 1535) at the other end in the Y direction of the printing element array 15*x* is relatively small, and the ink discharge amount from other printing elements is relatively large, suitable sub-heater heating control may not be able to be performed. For example, if only the temperature acquired from the temperature sensor S1 in the above case is used, the sub-heater is not heated regardless of the fact that printing elements No. 1532 through 1535 should be heated by sub-heater heating control. Even if the average value detected from multiple temperature sensors is used as in the first embodiment, the sub-heater may not be driven for the same reason if the temperatures detected at the temperature sensors S1 and S2 are markedly high.

Accordingly, the lowest temperature of temperatures acquired at three temperature sensors per sub-heater is extracted in the present embodiment, and this temperature is acquired as the representative temperature for sub-heater heating control. For example, in a case where the temperature at the temperature sensor S1 is 30° C., the temperature at the temperature sensor S2 is 25° C., and the temperature at the temperature sensor S3 is 45° C., the representative temperature for sub-heater heating control at the sub-heater 19*a* set to 25° C.

Setting the lowest temperature from the positions near each sub-heater as the representative temperature enables a situation to be suppressed in which the sub-heater is not driven when the temperature at one position is markedly lower than the temperature at another position. Although description has been made regarding the sub-heater 19*a*, the representative temperature for sub-heater heating control at the sub-heater 19*b* is acquired in the same way. This is also true for the sub-heaters provided to the printing element board 10*a* as well.

Sub-Heater Heating Control Based on Representative Temperature

Figure 10:
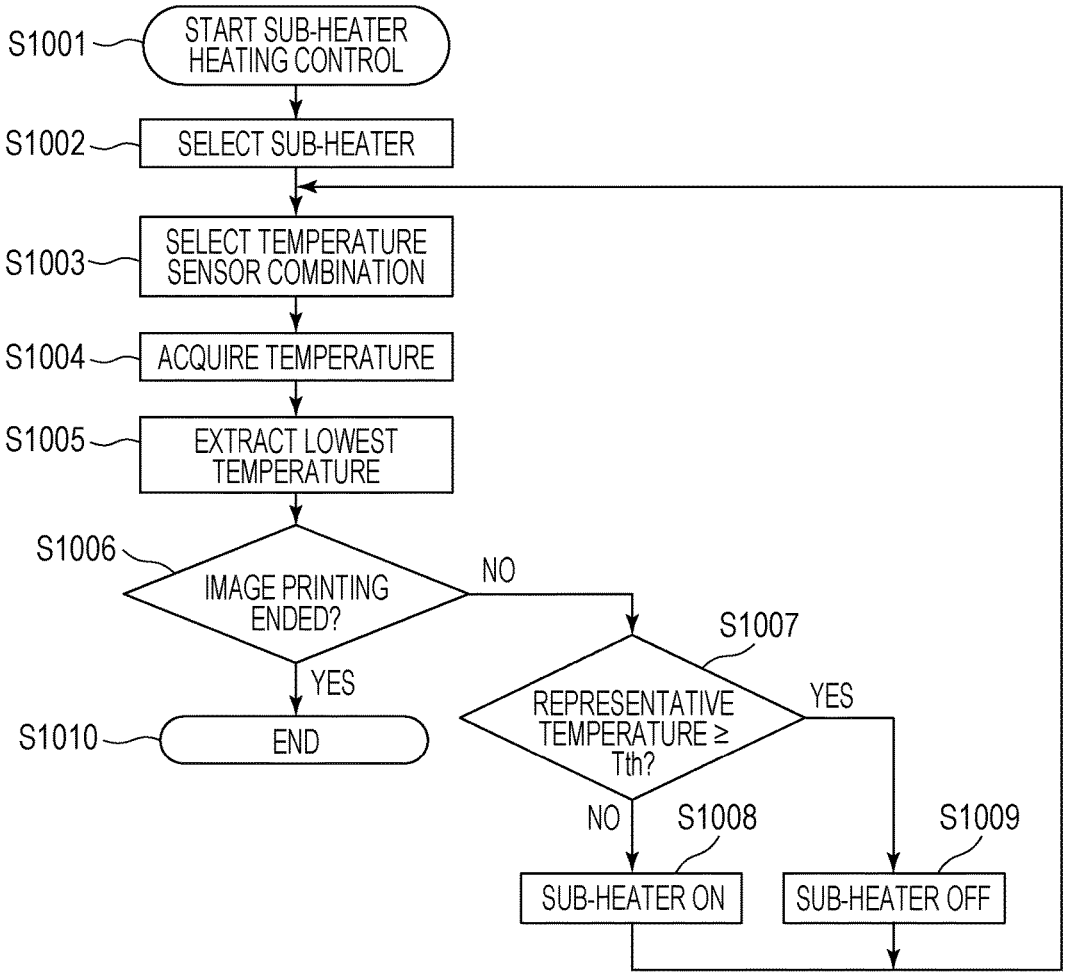
FIG. 10 is a flowchart for describing sub-heater heating control in the embodiment.

The sub-heater heating control based on representative temperature according to the present embodiment will be described in detail. FIG. 10 is a flowchart illustrating the process of representative temperature acquisition processing for sub-heater heating control, and sub-heater heating control.

Upon sub-heater heating control starting while printing (step S1001), one sub-heater is selected from multiple sub-heaters (step S1002). Although a case is described here where only one sub-heater is selected, for sake of brevity, multiple sub-heaters may be selected.

Next, a combination of temperature sensors to be used for acquiring the representative temperature of the selected sub-heater is selected (step S1003). For example, in a case where the sub-heater 19*a* has been selected in step S1002, the combination of temperature sensors S1, S2, and S3 is selected in step S1003, based in Table 2.

Next, the detected temperature values that correspond to the combination of temperature sensors selected in step S1003 are acquired from the detected temperature values stored in the RAM 103, that have been detected by the multiple temperature sensors S1 through S9 (step S1004). The temperature detection values from the temperature sensors are constantly updated in real-time to the newest values in the RAM 103.

The detected temperature value showing the lowest temperature is extracted from the detected temperature values acquired in step S1004, and that value is acquired as the representative temperature for sub-heater heating control (step S1005).

Next, determination is made regarding whether or not the image printing has ended (step S1006). In a case where determination is made that the image printing has not ended, in step S1007 determination is made regarding whether or not the acquired representative temperature is equal to or higher than a threshold temperature Tth. If determination is made that the representative temperature is lower than the threshold temperature Tth, heating by the sub-heater is performed (step S1008). On the other hand, if determination is made that the representative temperature is equal to or higher than the threshold temperature Tth, heating by the sub-heater is stopped (step S1009).

Thereafter, the flow returns to step S1003, and the same processing is repeated. In a case where determination is made in step S1006 that the image printing has ended, the sub-heater heating control ends as well (step S1010).

3. Overheating Protection Control

What is called overheating protection control, where printing is stopped when the ink temperature rises excessively during printing to prevent head damage due to overheating is performed in the present embodiment. A representative temperature acquired based on the temperatures detected by the multiple temperature sensors S1 through S9 is used as the ink temperature in the overheating protection control in the present embodiment. This acquisition method of the representative temperature will be described later.

When the temperature of the ink reaches or exceeds a predetermined threshold temperature Tmax while printing, the printing is temporarily stopped to suppress damage to the head in the overheating protection control according to the present embodiment. The threshold temperature Tmax is 80° C. in the present embodiment.

Third Representative Temperature Acquisition Method

In the present embodiment, all temperature detection values detected by the multiple temperature sensors are selected, and a representative temperature (hereinafter, also referred to as "third representative temperature") is acquired for overheating protection control based on these temperature detection values. This processing will be described below in detail.

In a case where ink overheats at a certain position within the printing head, the printing element boards 10*a* and 10*b* and printing elements 34 nearby that position may be damaged. Accordingly, the highest temperature of all temperature sensors is extracted in the present embodiment, and this temperature is acquired as the representative temperature for overheating protection control. Accordingly, printing can be stopped if overheating occurs at even one place, which is advantageous for overheating protection control.

For example, in a case where the temperature at temperature sensors S1 through S6 is 30° C., the temperature at temperature sensor S7 and S8 is 50° C., and the temperature at temperature sensor S9 is 85° C., the representative temperature for overheating protection control is found to be then 85° C. that is higher than the threshold temperature Tmax, and printing is stopped. Accordingly, overheating near the temperature sensor S9 can be suppressed.

Although an arrangement has been described where the detected temperature values of the temperature sensors S1 through S9 are used for sake of convenience, an arrangement where detected temperature values of temperature sensors provided on the printing element board 10*a* are used is even more preferable.

Overheating Protection Control Based on Representative Temperature

Figure 11:
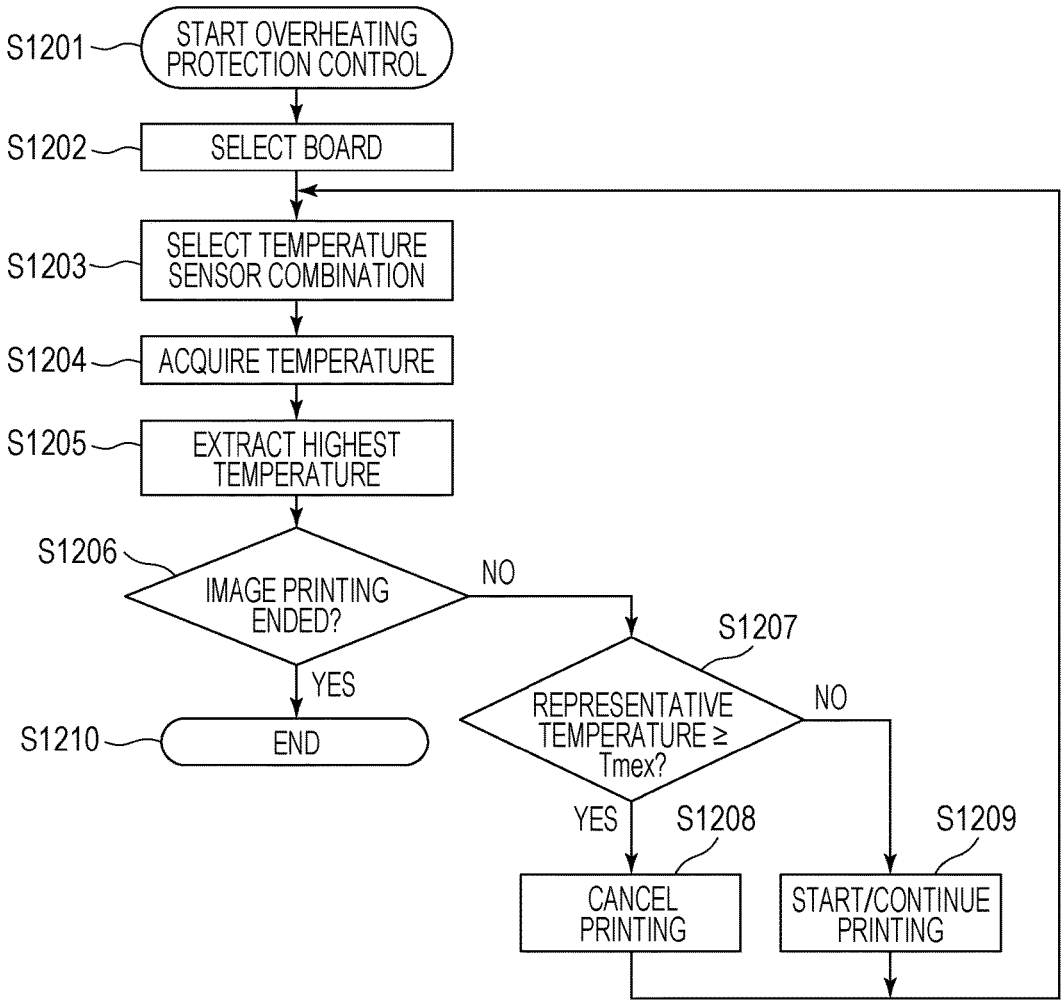
FIG. 11 is a flowchart for describing overheating protection control in the embodiment.

The overheating protection control based on representative temperature according to the present embodiment will be described in detail. FIG. 11 is a flowchart illustrating the process of representative temperature acquisition processing for overheating protection control, and overheating protection control processing.

Upon overheating protection control starting while printing (step S1201), one printing element board is selected from the two printing element boards 10*a* and 10*b* (step S1202). Although a case is described here where only one printing element board is selected, for sake of brevity, each of the two printing element boards may be selected.

Next, a combination of temperature sensors to be used for acquiring the representative temperature for overheating protection control for the selected printing element board is selected (step S1203). In this case, all temperature sensors provided on the printing element board are selected, as described above.

Next, the detected temperature values that correspond to all temperature sensors selected in step S1203 are acquired from the detected temperature values stored in the RAM 103, that have been detected by the multiple temperature sensors (step S1204). The temperature detection values from the temperature sensors are constantly updated in real-time to the newest values in the RAM 103.

The detected temperature value showing the highest temperature (largest value) is then extracted from the detected temperature values acquired in step S1204, and that value is acquired as the representative temperature for overheating protection control (step S1205).

Next, determination is made regarding whether or not the image printing has ended (step S1206). In a case where determination is made that the image printing has not ended, in step S1207 determination is made regarding whether or not the acquired representative temperature is equal to or higher than the threshold temperature Tmax. If determination is made that the representative temperature is equal to or higher than the threshold temperature Tmax, scanning of the printing head and printing operations are stopped (step S1208). On the other hand, if determination is made that the representative temperature is lower than the threshold temperature Tmax, printing operations are resumed if printing operations are stopped, and printing operations are continued if printing operations are being performed (step S1209).

Thereafter, the flow returns to step S1203, and the same processing is repeated. In a case where determination is made in step S1206 that the image printing has ended, the overheating protection control ends as well (step S1210).

4. Short-pulse Heating Control

What is called short-pulse heating control is performed in the present embodiment. In short-pulse heating control, short pulses of a duration short enough that ink is not discharged are applied to the printing elements 34 before starting printing and in between multiple scans. This raises the temperature of the ink before starting printing and in between scans to a predetermined target temperature by the thermal energy generated thereby.

In the short-pulse heating control according to the present embodiment, a representative temperature for each printing element array, acquired based on temperatures detected by the multiple temperature sensors S1 through S9, is used as the ink temperature for each printing element array, in the same way as the driving pulse control described above. The acquisition method of this representative temperature will be described later.

Figure 12:
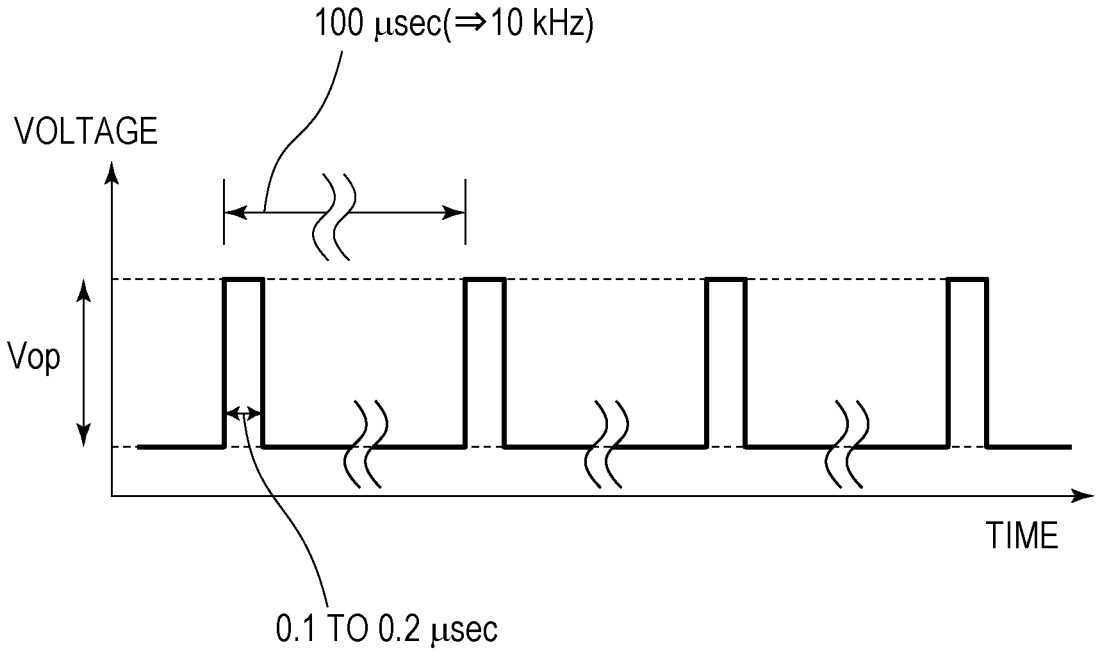
FIG. 12 is a diagram for describing short pulses used in the embodiment.

FIG. 12 is a diagram schematically illustrating short pulses applied when performing short-pulse heating control according to the present embodiment. The driving voltage in the short-pulse heating control according to the present embodiment is Vop (in units of volts) and, and square-wave pulses 0.1 to 0.2 μsec in duration are applied to the heating elements at a frequency of 10 kHz. The frequency of 10 kHz means that the time intervals between the square-wave pulses are 100 μsec.

The short pulses illustrated in FIG. 12 are applied before printing and between scans until the predetermined threshold temperature Tmin is reached in the short-pulse heating control according to the present embodiment. The threshold temperature Tmin is 40° C. in the present embodiment.

Fourth Representative Temperature Acquisition Method

In the present embodiment, multiple temperature detection values are selected for each printing element array from the nine temperature detection values detected by the multiple temperature sensors S1 through S9, and a representative temperature for performing short-pulse heating control at each printing element array is acquired based on the multiple temperature detection values. This processing will be described below in detail.

Temperature detection values (temperature information), acquired from four temperature sensors that are near to and surround one printing element array in the same way as in the above-described driving pulse control, are used to acquire a representative temperature (hereinafter, also referred to as "fourth representative temperature") for performing short-pulse heating control at that printing element array. Accordingly, the temperature sensors used to acquire the representative temperature for driving pulse control of each printing element array are the same as those shown in Table 1 above, in the same way as in the above-described driving pulse control.

Now, the temperature of the ink has preferably reached the threshold temperature Tmin at all positions of the printing head when performing printing. For example, if printing is started in a case where the ink temperature nearby the printing elements (No. 1532 through 1535) at the other end in the Y direction of the printing element array 15 is lower than the threshold temperature Tmin, and the ink temperature near the other printing elements is equal to or higher than the threshold temperature Tmin, the ink discharging amount may be insufficient at the printing elements No. 1532 through No. 1535 or discharge failure may occur.

Accordingly, the smallest temperature value of the four temperature sensors per printing element array is extracted, and used as the representative temperature at that printing element array for short-pulse heating control. For example, in a case where the average temperature at the temperature sensor S1 is 30° C., the average temperature at the temperature sensor S2 is 40° C., the average temperature at the temperature sensor S3 is 50° C., and the average temperature at the temperature sensor S4 is 60° C., the representative temperature at the printing element array 15*x* is 30° C.

Using the lowest temperature of the detected temperatures from all temperature sensors within the printing head as the representative temperature in this way enables suppression of a situation where the ink discharging amount is insufficient or discharge failure occurs, even in a case where the ink temperature at a certain position is lower than the threshold temperature Tmin, and the ink temperature at other positions is equal to or higher than the threshold temperature Tmin. Although description has been made here regarding the printing element board 10*b* having the printing element arrays 15*x* through 18*x*, the representative temperatures when performing sub-heater heating control at each of the printing element arrays 11*x* through 14*x* are acquired by the processing performed in the same way for the printing element board 10*a* having the printing element arrays 11*x* through 14*x*, as well.

Short-pulse Heating Control Based on Representative Temperature

Figure 13:
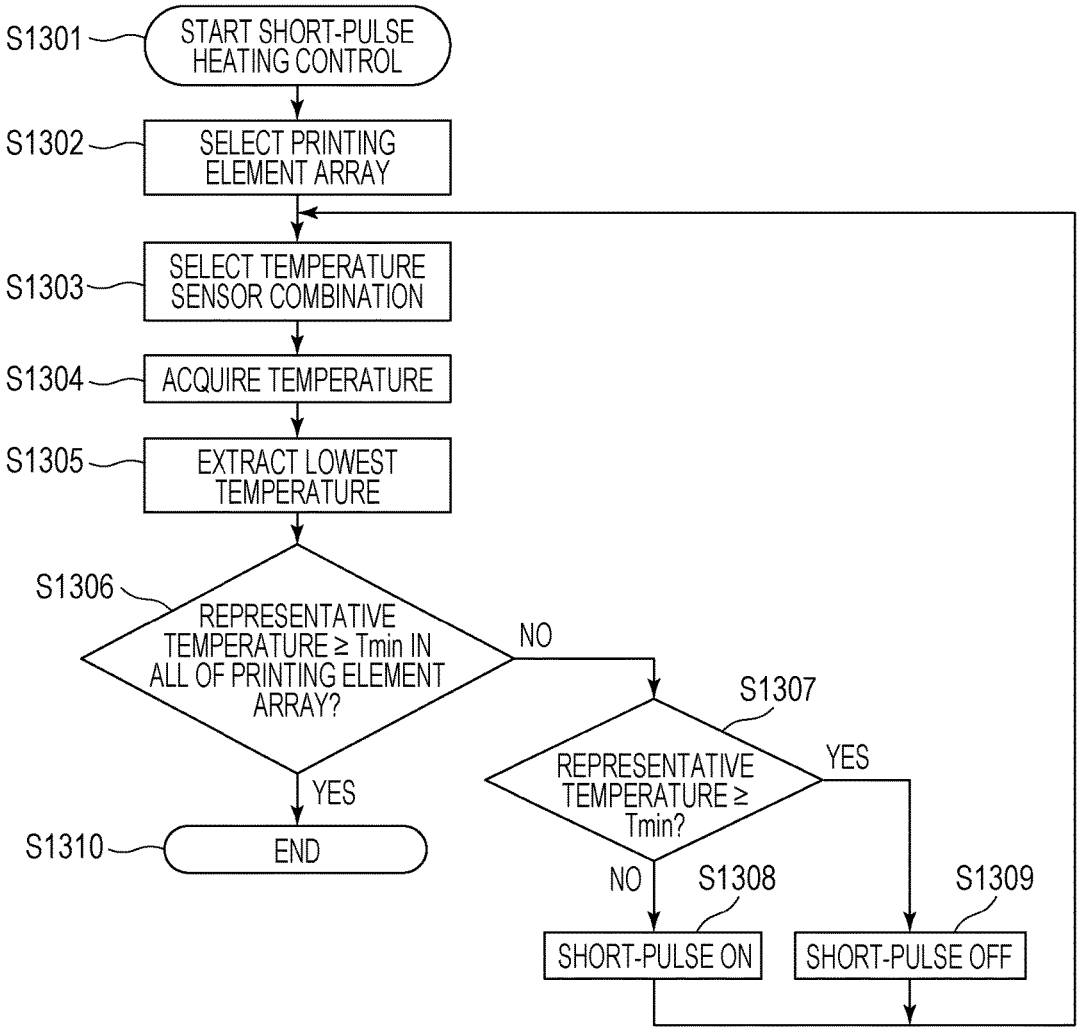
FIG. 13 is a flowchart for describing short-pulse heating control in the embodiment.

The short-pulse heating control based on representative temperature according to the present embodiment will be described in detail. FIG. 13 is a flowchart illustrating the process of representative temperature acquisition processing for short-pulse heating control processing, and short-pulse heating control processing.

Upon short-pulse heating control starting while printing (step S1301), one printing element array is selected from the multiple printing element arrays (step S1302). Although a case is described here where only one printing element array is selected, for sake of brevity, multiple printing element arrays may be selected.

Next, a combination of temperature sensors to be used for acquiring the representative temperature for short-pulse heating control is selected (step S1303). For example, in a case where the printing element array 15*x* has been selected, the combination of temperature sensors S1, S2, S3, and S4 is selected in step S1303 based on Table 1.

Next, the detected temperature values that correspond to the combination of temperature sensors selected in step S1303 are acquired from the detected temperature values stored in the RAM 103, that have been detected by the multiple temperature sensors S1 through S9 (step S1304). The temperature detection values from the temperature sensors are constantly updated in real-time to the newest values in the RAM 103.

The detected temperature value showing the lowest temperature is then extracted from the detected temperature values acquired in step S1304, and that value is acquired as the representative temperature for short-pulse heating control (step S1305).

Next, determination is made regarding whether or not the acquired representative temperature has reached or exceeded the threshold temperature Tmin in all of printing element array (step S1306).

Next, determination is made regarding whether or not the acquired representative temperature has reached or exceeded the threshold temperature Tmin in the printing element array selected in step S1302 (S1307).

If determination in step S1307 is made that there is a position of the printing element array where the temperature is still lower than the threshold temperature Tmin, short pulses are applied to the printing elements to perform heating (step S1308). On the other hand, if determination in step S1307 is made that the representative temperature is equal to or higher than the threshold temperature Tmin, short pulses are not applied (step S1309).

Thereafter, the flow returns to step S1303, and the same processing is repeated. In a case where determination is made in step S1306 that the representative temperature at the printing element array has reached or exceeded the threshold temperature Tmin, the short-pulse heating control ends as well (step S1310).

As described above, the temperature sensors used out of the multiple temperature sensors for calculation of the representative temperature, and calculation methods of representative temperature, are made to differ among the four types of temperature control, which are driving pulse control, sub-heater heating control, overheating protection control, and short-pulse heating control. Thus enables suitable representative temperature calculation when performing temperature control according to the present embodiment.

Figure 14A:
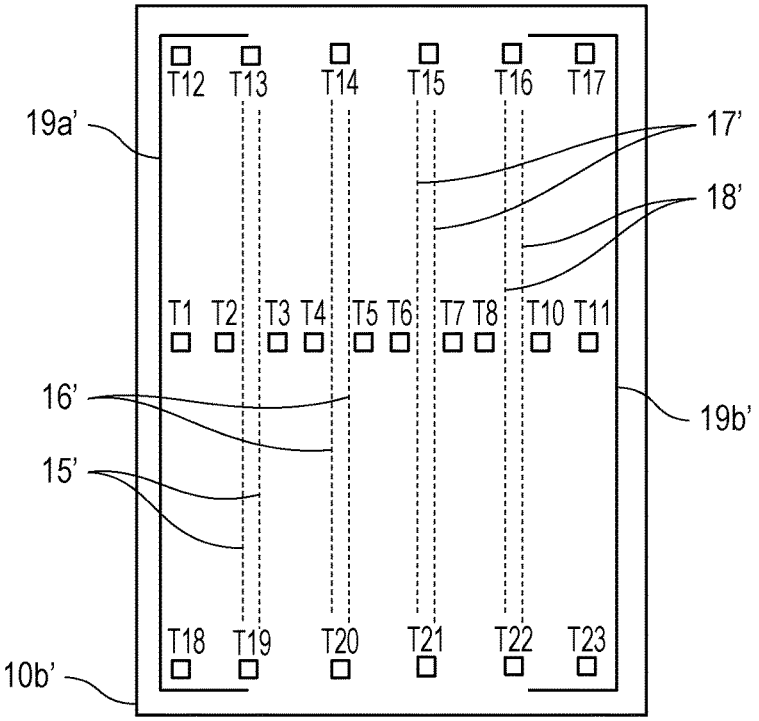
FIGS. 14A and 14B are diagrams illustrating reference examples of boards.
Figure 14B:
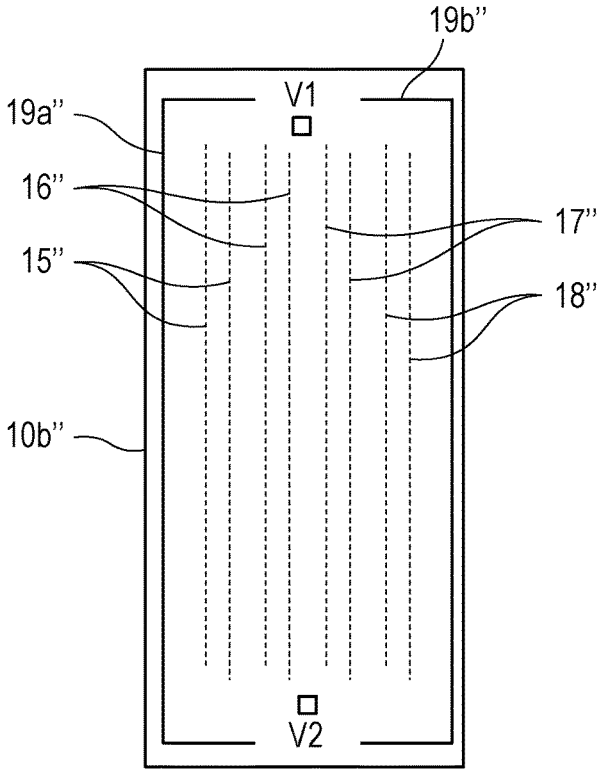

Comparison between reference examples and the present embodiment will be described below in detail, to confirm the advantages of the present embodiment. FIGS. 14A and 14B are diagrams schematically illustrating a printing element board according to a reference example. FIG. 14A illustrates a printing element board (reference example 1) where multiple dedicated temperature sensors T1 through T23 are provided to the printing element arrays and sub-heaters. FIG. 14B illustrates a printing element board (reference example 2) where temperature sensors (V1 and V2) are disposed only on both end portions in the Y direction.

The printing element board 10*b*' illustrated in FIG. 14A has four dedicated temperature sensors for each of printing element arrays 15' through 18'. In the same way, three dedicated temperature sensors are provided to the sub-heaters 19*a*' and 19*b*' as well. A great number of temperature sensors are provided to the printing element board 10*b*' as illustrated in FIG. 14A, so the size of the printing element board 10*b*' was enlarged to 12.05 mm horizontally and 39.0 vertically, which is a width-wise increase of 2.5 mm as compared to the printing element board 10*b* used in the present embodiment, illustrated in FIG. 3A. This increase in the number of temperature sensors and the expansion of the printing element board of the printing element board 10*b*' illustrated in FIG. 14A causes a great increase in costs as compared to the printing element board 10*b* illustrated in FIG. 3A.

On the other hand, the printing element board 10*b*" illustrated in FIG. 14B only has two temperature sensors, provided to both end portions in the Y direction. The size of the printing element board 10*b*" was thus reduced as compared to the printing element board 10*b* illustrated in FIG. 3A, to a size of 7.5 mm horizontally and 39.0 vertically.

Figure 15A:
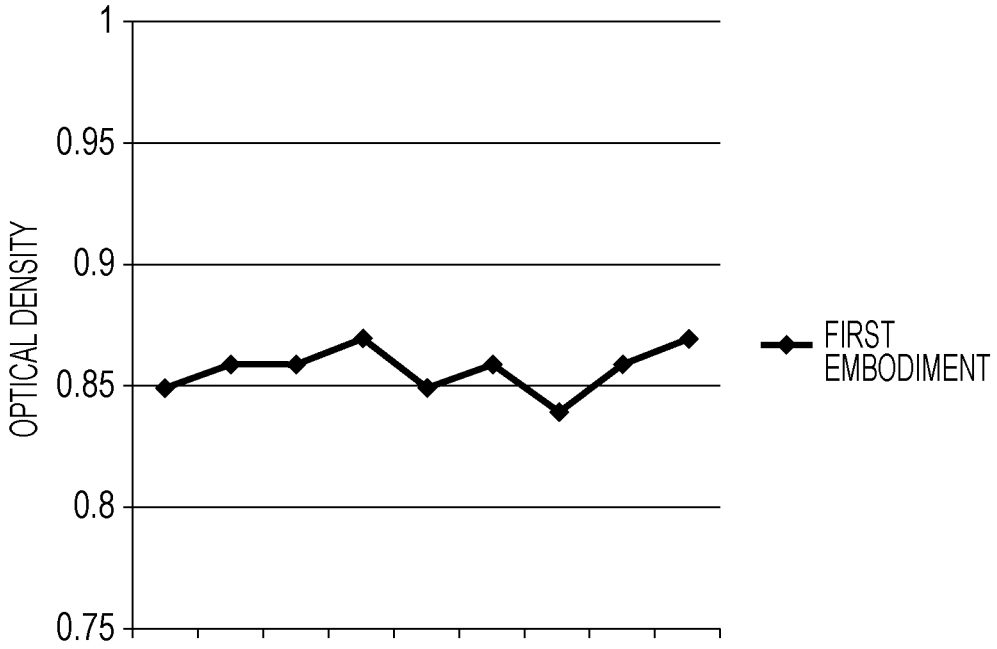
FIGS. 15A and 15B are diagrams illustrating optical density when printing an image by performing driving pulse control.
Figure 15B:
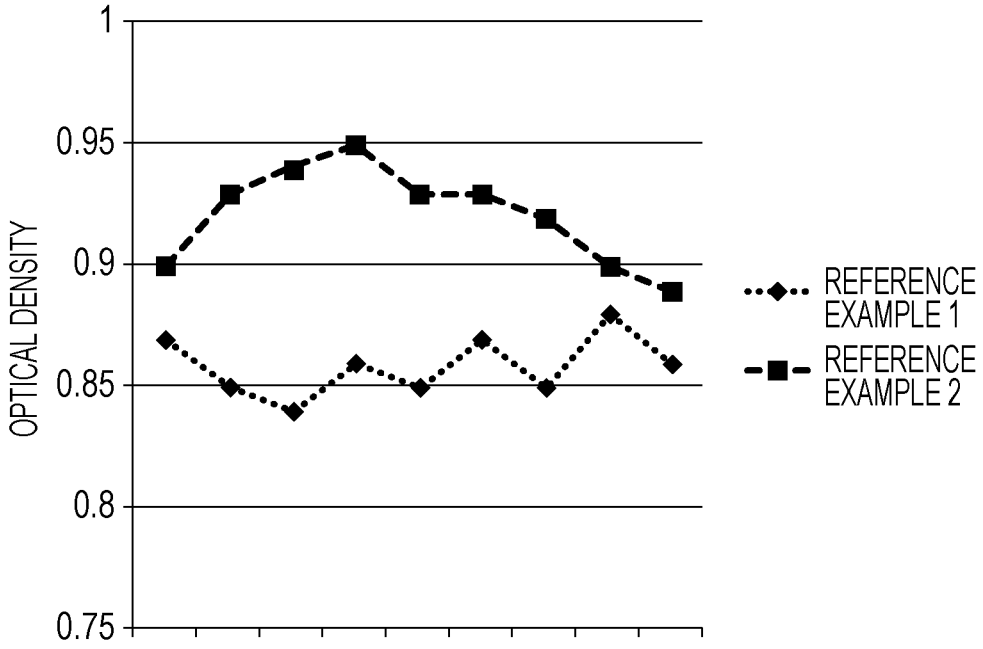

FIG. 15A is a diagram illustrating transition of optical density of an image when printing while performing driving pulse control according to the present embodiment. FIG. 15B is a diagram illustrating transition of optical density of an image when printing while performing driving pulse control, according to a representative temperature acquisition method the same as the present embodiment, using the printing element boards 10*b*' and 10*b*" illustrated in FIGS. 14A and 14B.

It can be seen from FIG. 15A that the optical density transitions between 0.84 and 0.87 in the image printed by performing the driving pulse control according to the present embodiment. The printing head temperature rises as the image is being printed, but it can be seen that increase in the amount of discharge is suppressed, since the first representative temperature is appropriately acquired and driving pulse control is performed based upon the representative temperature.

It can be seen from FIG. 15B that the optical density transitions between 0.84 to 0.88 in the image printed by performing the driving pulse control according to the present embodiment, using the printing element board 10*b*' illustrated in FIG. 14A. Thus, advantages generally the same as the present embodiment can be obtained with regard to image quality, by using the printing element board 10*b*' illustrated in FIG. 14A. On the other hand, performing the driving pulse control according to the present embodiment, using the printing element board 10*b*" illustrated in FIG. 14B, results in optical density transitioning between 0.89 to 0.95. It is thought that the temperature sensors have detected temperatures lower than a suitable representative temperature, since there are no temperature sensors disposed at the middle portion. As a result, it can be presumed that driving pulses having a longer pre-pulse width than the driving pulses that should have been applied were applied, and the ink discharge amount was excessive. It thus can be presumed that a suitable representative temperature cannot be calculated when using the printing element board 10*b*" illustrated in FIG. 14B.

Thus, it can be confirmed that using the printing element board illustrated in FIGS. 3A and 3B and performing the temperature control, described according to the present embodiment enables cost of the printing element board to be suppressed, and suitable temperature control can be performed even when multiple types of temperature control are performed.

Second Embodiment

The first embodiment has been described with regard to an arrangement where heating by sub-heaters is stopped in a case where the representative temperature is the threshold temperature Tth or higher in sub-heater heating control to keep ink warm while printing. In comparison with this, an arrangement will be described in a second embodiment where heating by sub-heaters is performed again when the representative temperature reaches or exceeds a threshold temperature Tth_2 that is higher than the threshold temperature Tth. Note that portions which are the same as those of the first embodiment described above will be omitted from description.

In a case where a 100% duty image is to be printed using all printing element arrays 15, the rise of ink temperature tends to be the same among the printing elements of the printing element arrays 15, since ink is discharged at a uniform frequency. However, in practice, there are cases where the temperature rises with the ink nearby printing elements at the end portions in the Y direction of the printing element array and ink nearby printing elements at the middle portions in the Y direction of the printing element array rise with different tendencies. More specifically, the ink nearby printing elements at the end portions in the Y direction does not rise as readily as ink nearby printing elements at the middle in the Y direction. It is thought that this is due to the neighborhood of printing elements at the end portions in the Y direction being of a nature where heat is dissipated into the atmosphere via the printing element board 10*b* more readily.

Figure 16A:
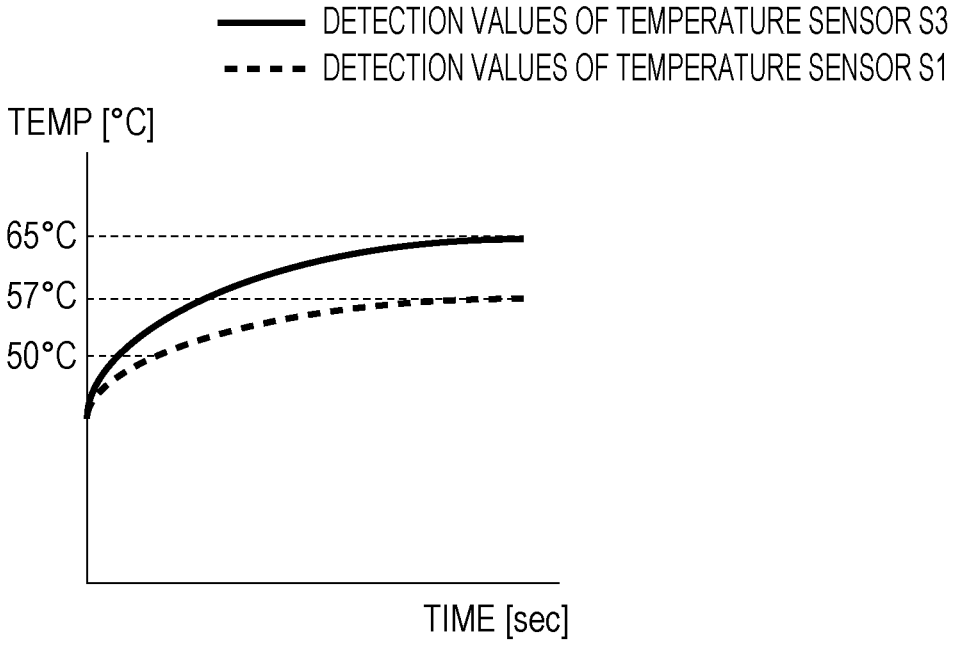
FIGS. 16A and 16B are diagram for describing temperature transition and temperature distribution within a printing element array.
Figure 16B:
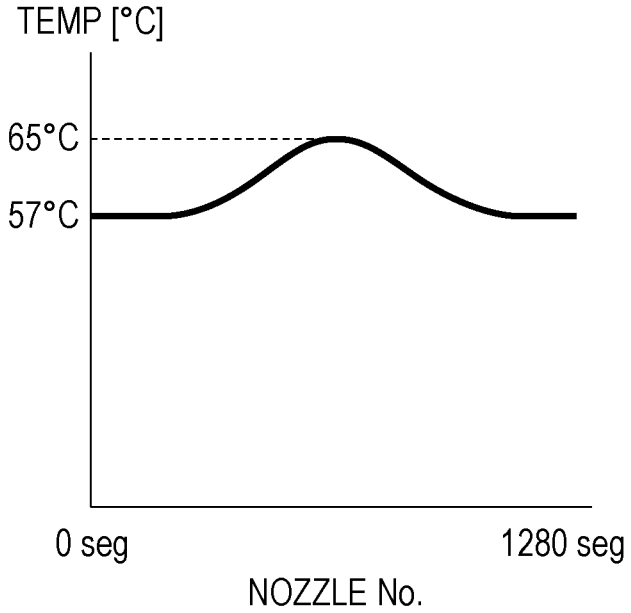

FIGS. 16A and 16B are diagrams schematically illustrating the transition of ink temperature near the printing elements at the ends in the Y direction of the printing element array 15, and printing elements at the middle portion. As an example, the temperature at the ends in the Y direction was acquired by the temperature sensor S1, and the temperature at the middle in the Y direction was acquired by the temperature sensor S3.

It can be seen from FIG. 16A that the temperature at the middle portion raises faster than the temperature at the ends, as printing is being performed. Finally, the temperature at the middle portion has risen to 65° C., while the temperature at the ends is 57° C., which is relatively low. Performing printing by applying driving pulses in this state where there is a temperature distribution within the printing element array may result in difference in the amount of ink discharged among the printing elements, and unevenness in color density may occur in the obtained image.

Accordingly, the sub-heater heating control according to the present embodiment is performed with sub-heaters performing heating such that there is no such temperature distribution within the printing element array. More specifically, even if the representative temperature at the time of sub-heater heating control is the threshold temperature Tth or higher, if the temperature difference between the temperature at the middle portion of the printing element array and at the ends exceeds a predetermined threshold value Tth_2, heating is performed by sub-heaters. The threshold value Tth_2 in the present embodiment is 5° C.

It can be seen from FIG. 3A that the sub-heaters 19*a* and 19*b* are formed to cover the end portions of the printing element arrays in the Y direction to a certain extend. Accordingly, the heating by the sub-heaters 19*a* and 19*b* is centralized more on the ends than the middle portion of the printing element array. According to this configuration, occurrence of temperature distribution can be suppressed by heating using the sub-heaters when the temperature at the middle portion is higher than the temperature at the ends by a certain amount, due to difference in thermal dissipation properties.

Of the four temperature sensors surrounding the printing element arrays to calculate the difference in temperature, the temperature difference between the lower of the detected temperature value of the two temperature sensors situated at the ends and the higher of the detected temperature value of the two temperature sensors situated at the middle, is acquired in the present embodiment. for example, in a case of calculating the temperature difference at the printing element array 15, and the temperature at the temperature sensor S1 is 30° C., the temperature at the temperature sensor S2 is 40° C., the temperature at the temperature sensor S3 is 50° C., and the temperature at the temperature sensor S4 is 60° C., the temperature difference is 30° C., which is the difference between the temperature 30° C. at the temperature sensor S1 and the temperature 60° C. at the temperature sensor S4.

Figure 17:
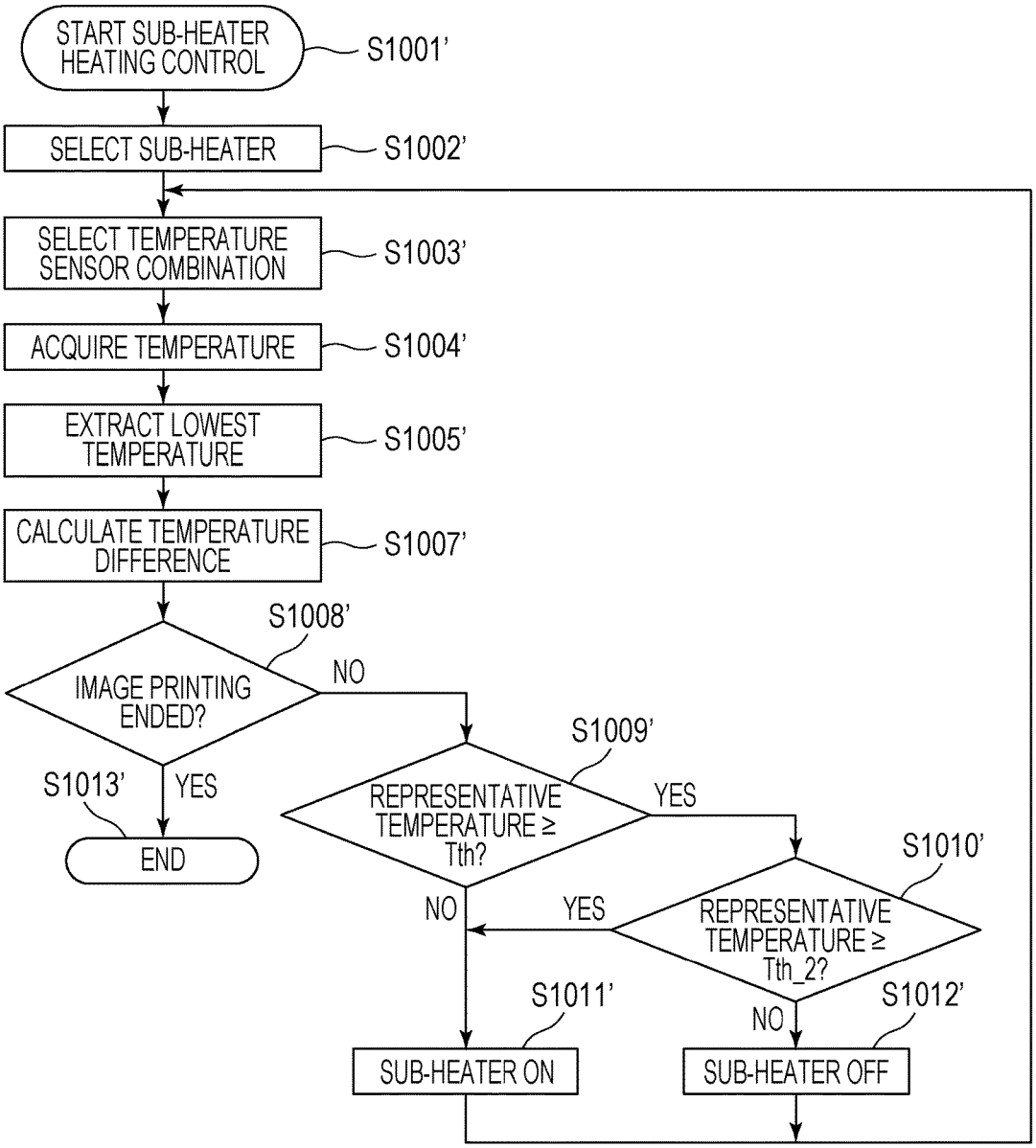
FIG. 17 is a flowchart for describing sub-heater heating control according to the embodiment.

FIG. 17 is a flowchart illustrating the process of sub-heater heating control processing according to the present embodiment. Step S1001' and step S1002' are the same as step S1001 and step S1002 in FIG. 10, so description will be omitted.

Next, a combination of temperature sensors to use for acquiring the representative temperature of the selected sub-heater, and a combination of temperature sensors to use for calculating the temperature difference, are selected (step S1003'). In a case where the sub-heater 19*a* is selected in step S1002', for example, in step S1003' the combination of temperature sensors S1, S2, and S3 is selected based on Table 2. further, in a case of calculating the temperature difference at the printing element array 15, the combination of temperature sensors S1, S2, S3, and S4 is selected.

Next, the detected temperature values acquired from the combination of temperature sensors selected in S1003' used to acquire the representative temperature for sub-heater heating control are acquired (step S1004'). Further, the detected temperature values acquired from the combination of temperature sensors selected in S1003' to calculate the temperature difference of the printing element arrays, are acquired (step S1004').

The detected temperature value which has the lowest temperature of the detected temperature values from the temperature sensors used to acquire the representative temperature for sub-heater heating control is then extracted, and that value is acquired as the representative temperature for second sub-heater heating control (step S1005'). For example, the representative temperature for sub-heater heating control of the sub-heater 19*a* is the lowest temperature of the detected temperature values from the temperature sensors S1, S2, and S3.

Next, the difference in detected temperature values from the temperature sensors used to calculate the temperature difference is calculated as described above, and the temperature difference is acquired (step S1007').

Next, determination is made regarding whether or not the image printing has ended (step S1008'). In a case where determination is made that the image printing has not ended, in step S1009' determination is made regarding whether or not the acquired representative temperature is equal to or higher than the threshold temperature Tth. If determination is made that the representative temperature is lower than the threshold temperature Tth, heating by the sub-heater is performed (step S1011'). On the other hand, if determination is made that the representative temperature is equal to or higher than the threshold temperature Tth, determination is made regarding whether or not the temperature difference is the predetermined threshold value Tth_2 or larger (step S1010'). In a case where determination is made that the temperature difference is smaller than the predetermined threshold value Tth_2 (5° C.), heating by the sub-heater is stopped (step S1012').

On the other hand, in a case where determination is made that the temperature difference is equal to or larger than the predetermined threshold value Tth_2 (5° C.), a temperature distribution may be occurring within the printing element array, so heating by the sub-heater is performed (step S1011'). As described above, the heating by the sub-heaters is centralized more on the ends of the printing element array, so even in a case where a temperature distribution occurs within the printing element array, the temperature distribution can be speedily resolved according to this configuration.

Thereafter, the flow returns to step S1003', and the same processing is repeated. In a case where determination is made in step S1008' that the image printing has ended, the sub-heater heating control ends as well (step S1013').

Figure 18A:
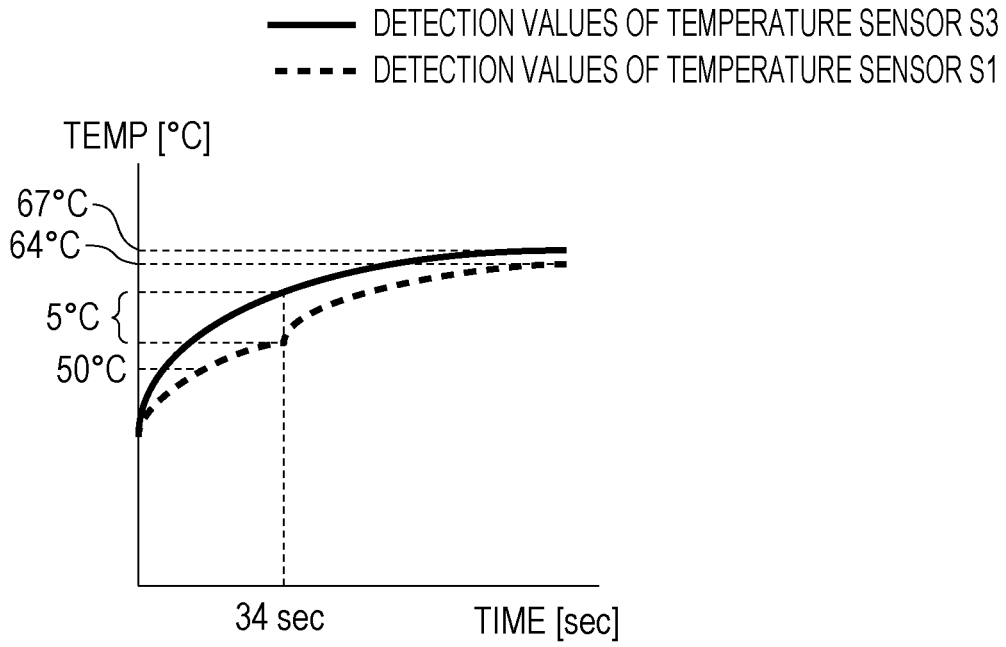
FIGS. 18A and 18B are diagram for describing temperature transition and temperature distribution within a printing element array.
Figure 18B:
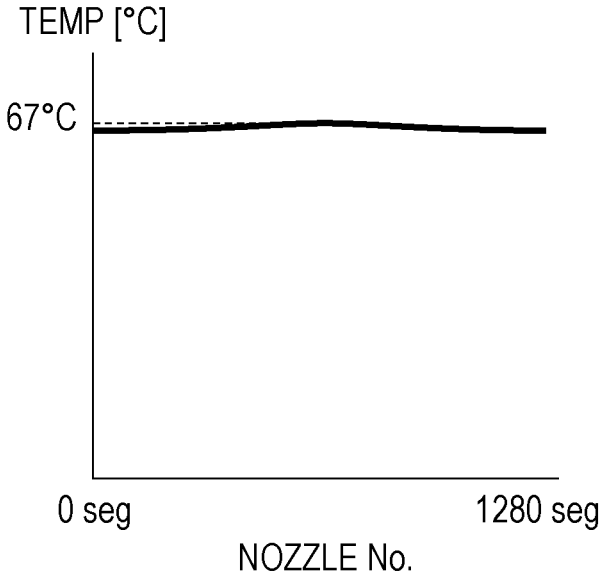

FIGS. 18A and 18B are diagrams schematically illustrating the transition of ink temperature near the printing elements at the ends in the Y direction of the printing element array 15, and printing elements at the middle portion in the Y direction, where sub-heater heating control according to the present embodiment was performed. As an example, the temperature at the ends in the Y direction was acquired by the temperature sensor S1, and the temperature at the middle in the Y direction was acquired by the temperature sensor S3.

It can be seen from FIG. 18A that the temperatures at the middle and end portions rise following the same temperature transition tendencies as illustrated in FIG. 16A until 34 seconds after having starting printing. The temperature difference between the temperature at the middle portion and the temperature at the ends exceeds 5° C., which is the threshold value Tth_2, at the point where 34 seconds have elapsed after having starting printing, and it is at this point where the sub-heater is driven. As described above, the heating by the sub-heaters is centralized more on the ends of the printing element array, so finally the temperature at the middle was 67° C. and the temperature at the ends was 64° C., as illustrated in FIG. 18B. Accordingly, it can be seen that the temperature distribution within the printing element array can be resolved.

According to the above configuration, in addition to suitable processing being enabled in multiple types of temperature processing, temperature distribution within printing element arrays can be resolved in sub-heater heating control.

Third Embodiment

The first and second embodiments have been described with regard to an arrangement where the ink temperature is raised by performing only short-pulse heating control before starting printing. In comparison with this, an arrangement will be described in a third embodiment where heating by sub-heaters is performed a predetermined amount of time before starting printing, and thereafter the ink temperature is raised by performing short-pulse heating control. Note that portions which are the same as those of the first and second embodiments described above will be omitted from description.

As described in the second embodiment, heat is dissipated into the atmosphere via the printing element board 10*b* more readily at printing elements near the end portions in the Y direction, so the temperature of ink near the printing elements at the ends in the Y direction does not rise as readily as the ink near the printing elements at the middle in the Y direction. Accordingly, if the same short pulses are uniformly applied to all printing elements within the printing element array before starting printing, a temperature distribution may be formed in the printing element array even before starting printing.

Figure 19A:
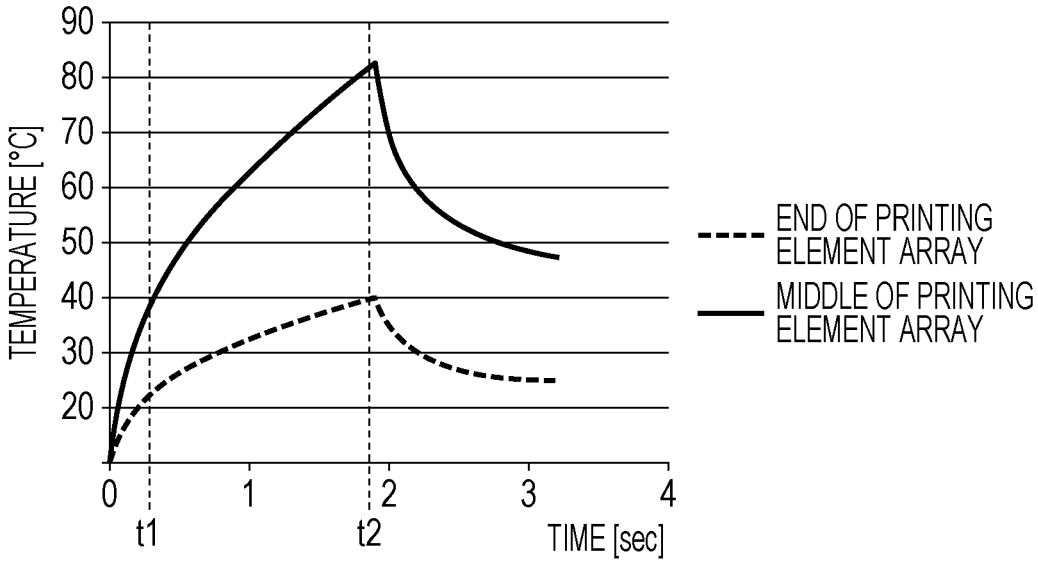
FIGS. 19A and 19B are diagram for describing temperature transition and temperature distribution within a printing element array.
Figure 19B:
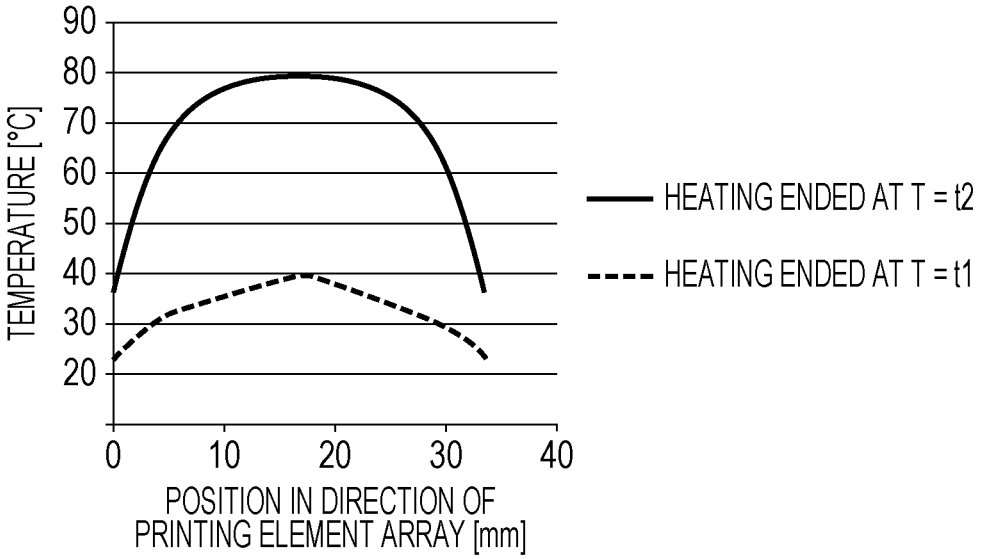

FIGS. 19A and 19B are schematic diagrams illustrating the temperature transition and temperature distribution at the middle and end portions in the Y direction of a printing element array where the same short pulses are uniformly applied to all printing elements. As described above, in a case where short pulses are uniformly applied to all printing elements the temperature at the middle of the printing element array rises more readily than the temperature at the end, due to the heat dissipation at the ends of the printing element array. Accordingly, at a timing where time T=t1 ($0<t1<0.5$) seconds have elapsed after starting short-pulse heating control, the temperature at the middle portion reaches 40° C., which is the threshold temperature Tmin, as illustrated in FIG. 19A. At this timing, the temperature at the ends is 23° C.

The short-pulse heating control is continued, and at a timing where time T=t2 ($1.5<t2<2$) seconds have elapsed, the temperature at the ends reaches 40° C., which is the threshold temperature Tmin. At this timing, the middle portion has been further heated for (t2−t1) seconds after having reached the threshold temperature Tmin, and the temperature is approximately 80° C.

FIG. 19B is a diagram illustrating temperature distribution within the printing element array after having performed short-pulse heating. The solid line in FIG. 19B is the temperature distribution t2 seconds after having started short-pulse heating control, and the dotted line is the temperature distribution t1 seconds after having started short-pulse heating control.

At the timing T=t1 where the middle portion of the printing element array reaches the threshold temperature Tmin, the temperature at the ends is lower than the threshold temperature Tmin, as described above. In a case where ink is discharged at a timing T−t1 seconds after starting short-pulse heating control, the temperature at the ends has not reached the threshold temperature Tmin, the ink discharging amount may be insufficient or discharge failure may occur at the printing elements at the ends.

On the other hand, at the timing T=t2 seconds when the temperature at the ends of the printing element array reach the threshold temperature Tmin, the temperature at the middle portion has greatly surpassed the threshold temperature Tmin. This phenomenon where the threshold temperature Tmin is greatly surpassed during heating is called the overshoot phenomenon. Accordingly, if ink is discharged in this state, the ink discharge amount from the printing elements at the middle portion may increase. Further, in a case where the material of the orifice portion disposed facing the printing elements is resin or the like, there are cases where the material of the orifice portion gradually is deformed by thermal stress applied due to this overshoot phenomenon. Deformation of the material of the orifice portion may result in reduced durability of the printing head.

Accordingly, heating control by the sub-heaters is first performed before starting printing (hereinafter also referred to as "pre-printing sub-heater heating control") is performed for a predetermined amount of time in the present embodiment, and thereafter the short-pulse heating control is performed. The pre-printing sub-heater heating control and short-pulse heating control is ended at the point that the fourth representative temperature reaches the threshold temperature Tmin, in the same way as in the first embodiment. Accordingly, discharge failure, deformation of the orifice portion material, and so forth, due to temperature distribution in the printing element array at the time of starting printing, is suppressed.

Figure 20:
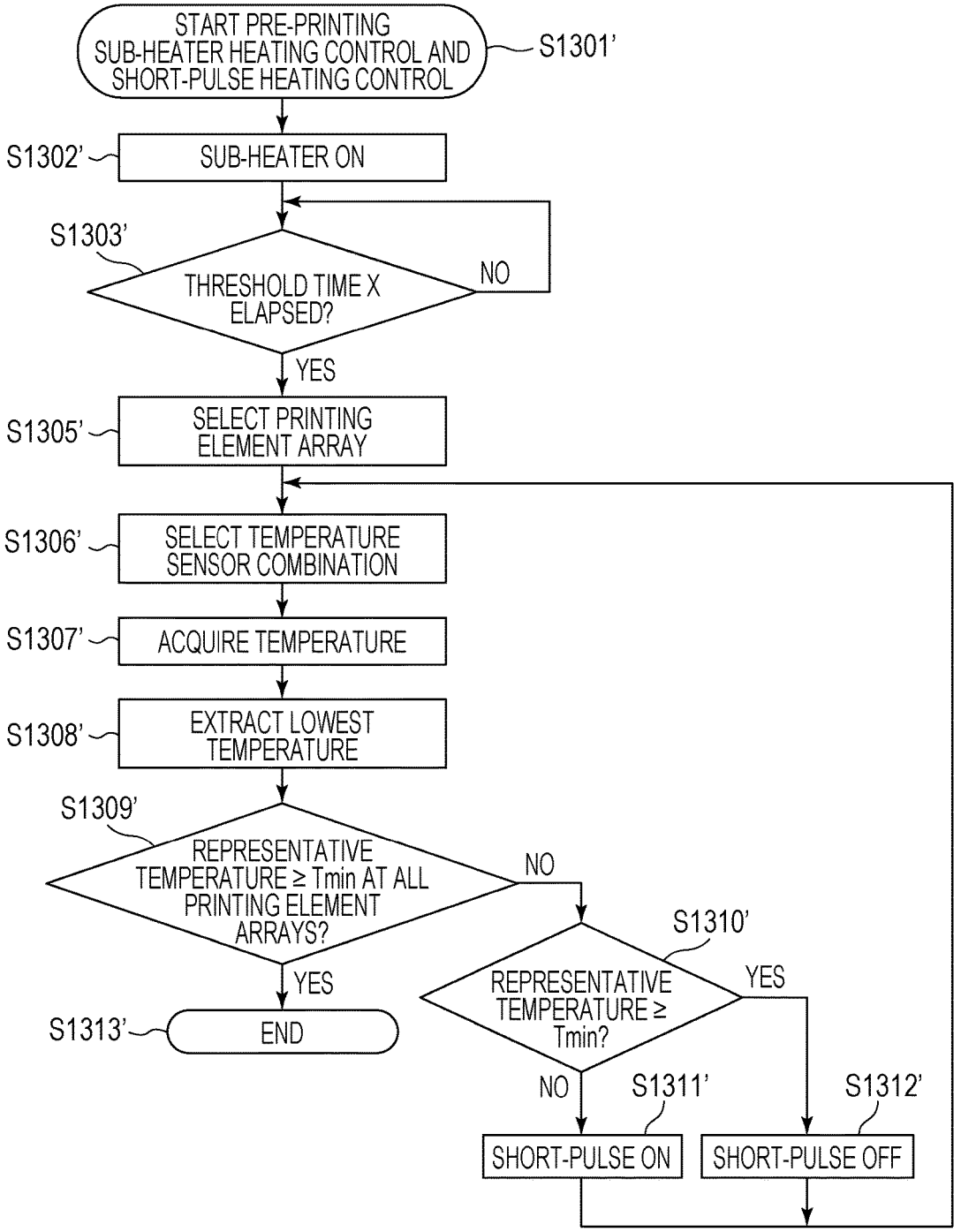
FIG. 20 is a flowchart for describing pre-printing sub-heater heating control according to the embodiment.

FIG. 20 is a flowchart illustrating the process of pre-printing sub-heater heating control processing and short-pulse heating control according to the present embodiment. First, upon the pre-printing sub-heater heating control and short-pulse heating control being started (step S1301'), heating by the sub-heater is started (step S1302').

Next, determination is made regarding whether or not heating by the sub-heater has been performed for a predetermined threshold time X (step S1303'). Although this threshold time X is set to 1 second in the present embodiment, the threshold time may be set as appropriate according to the apparatus temperature or the like of the printing apparatus. In a case where determination is made in step S1303' that time for the threshold time X has not yet elapsed from the time of starting heating by the sub-heater, heating by the sub-heater is continued. On the other hand, In a case where determination is made that the predetermined threshold time X has elapsed, processing the same as the printing element array selection processing in step S1302 in the first embodiment is performed while continuing heating by the sub-heater (step S1305').

The processing in the subsequent step S1306' through step S1310' is the same as the processing in step S1302 through step S1307 in FIG. 13, so description will be omitted.

In a case where determination has been made in step S1310' that the representative temperature is lower than the temperature Tmin, in step S1311' both short pulse heating and the pre-printing sub-heater heating are performed. On the other hand, in a case where determination has been made in step S1310' that the representative temperature has reached or exceeded Tmin, in step S1312' both short pulse heating and the pre-printing sub-heater heating are stopped. These operations are repeated, and when determination is made in step S1309' that the representative temperature has reached or exceeded Tmin in all printing element arrays, both short pulse heating control and the pre-printing sub-heater heating control are stopped (Step S1313').

Figure 21A:
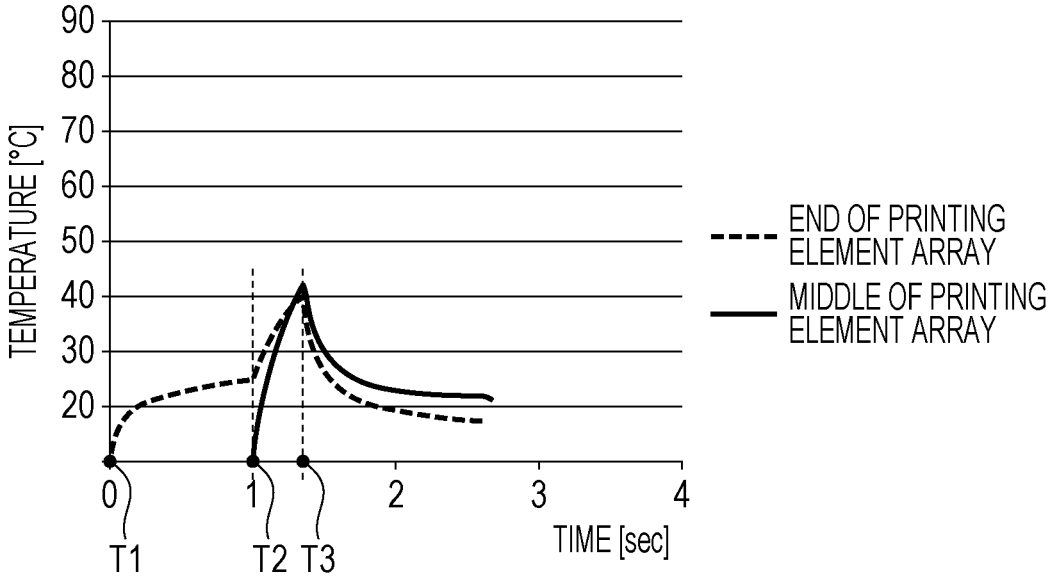
FIGS. 21A and 21B are diagram for describing temperature transition and temperature distribution within a printing element array.
Figure 21B:
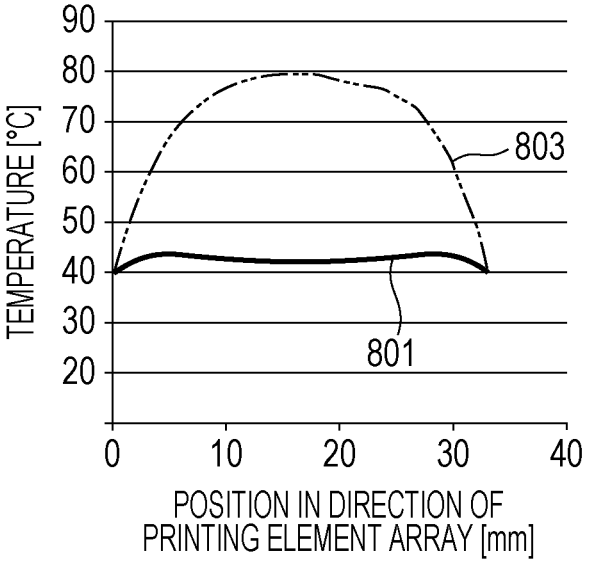

FIGS. 21A and 21B are a diagram schematically illustrating the temperature transition and temperature distribution at the middle portion and ends of a printing element array when performing the pre-printing sub-heater heating control and short pulse heating control according to the present embodiment.

First, at the first timing T1 immediately after having started the pre-printing sub-heater heating control and short pulse heating control, sub-heater heating is performed. The thermal energy generated by driving the sub-heaters is provided centralized at the ends of the printing element board in the Y direction, so for a while after the first timing T1, only the ink temperature at the ends of the printing element array rises.

After the second timing T2 where one second, which is the threshold time X, has elapsed from the first timing T1, short pulse heating is also performed. Driving pulses are applied to the printing elements of the printing element array in the same way, so thermal energy from the short pulse heating is uniformly applied throughout the printing element array. Note however, that marked thermal dissipation occurs at the ends of the printing element board in the Y direction, so the temperature tends to rise more readily at the middle portion of the printing element array in the Y direction after the second timing T2.

Accordingly, time further passes from the second timing T2, and at a third timing T3 where the representative temperature reaches 40° C. that is the threshold temperature Tmin, the ink temperature at the ends of the printing element array and the ink temperature at the middle portion are about the same.

The temperature distribution in the printing element array occurring at the time of having performed the heating control according to the present embodiment is indicated by solid line 801 in FIG. 21B. The dashed line 803 in FIG. 21B corresponds to the temperature distribution occurring in a case where the ink is heated only by short pulse heating in FIG. 19B. It can be seen from FIG. 21B that the temperature distribution in the printing element array can be reduced by performing sub-heater heating before performing short pulse heating.

The temperature distribution in the printing element array can also be reduced by an arrangement where short pulse heating control is first performed before starting printing, and subsequently performing pre-printing sub-heater heating control. However, in the case of performing heating in the order of short pulse heating control and then pre-printing sub-heater heating control there may be marked cases of the overshoot phenomenon occurring. The reason is that generally, the amount of thermal energy provided from the short pulse heating control is far greater than the amount of thermal energy provided by the pre-printing sub-heater heating control.

According to the configuration described above, in addition to appropriate processing being performed in multiple types of temperature control, temperature distribution within printing element arrays that may occur before starting printing can be resolved.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Although the embodiments have been described regarding arrangements where four types of temperature control are performed, namely, driving pulse control, sub-heater heating control, overheating protection control, and short-pulse heating control, the embodiments are applicable in an arrangement where at least two types of temperature control can be performed. For example, an arrangement may be made where just the two types of sub-heater heating control and short pulse heating control are performed. Further, it is needless to say that arrangements may be made where five types of more of temperature control are performed.

Although description has been made in the above embodiments regarding an arrangement where the overheating protection control is performed regarding the highest temperature of the temperatures detected by the multiple temperature sensors, this is applicable to other arrangements. For example, an arrangement may be made where the highest temperature is weighted, the weighted average of the temperatures detected by the multiple temperature sensors is calculated, and this value is used as the representative temperature for overheating protection control.

Also, an arrangement has been described in the above embodiments regarding driving pulse control in the above embodiments where a simple average value of temperatures detected by the four temperature sensors surrounding the printing element array is used, other arrangements may be made. For example, an arrangement may be made where the highest temperature of the temperatures detected by the four temperature sensors is weighted and the weighted average is calculated, and this value is used as the representative temperature for driving pulse control.

Also, an arrangement has been described in the above embodiments where scanning is performed multiple times as to a printing medium, thereby printing images, but other arrangements may be made. For example, the temperature control according to the embodiments may be applied to an arrangement of a printing apparatus where a long printing head, that is longer than the width of the printing medium, is used, and ink is discharged from the printing heat to print an image while conveying the printing medium just one time in the direction orthogonal to the width direction.

According to the ink jet printing apparatus and ink jet printing method according to the present invention, suitable control can be executed in each of multiple types of temperature control.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-044054, filed Mar. 5, 2015, which is hereby incorporated by reference herein in its entirety.

What is claimed is:

1. An ink jet printing apparatus that performs printing by discharging ink, the ink jet printing apparatus comprising:

a printing head including at least a board, a printing element array disposed on the board, in which a plurality of printing elements configured to generate thermal heat to discharge ink are arrayed in a predetermined direction, and a plurality of detecting elements disposed at different positions from each other in the board, and configured to detect temperature at their respective positions;

an acquisition unit configured to acquire a plurality of information pieces relating to temperatures that have been detected by the plurality of detecting elements;

a selecting unit configured to select a predetermined combination of the information pieces from the plurality of information pieces acquired by the acquisition unit; and a control unit configured to effect a plurality of types of temperature control relating to ink temperature nearby the printing element array, based on the information pieces selected by the selecting unit, wherein the selecting unit selects combinations of information pieces that are different from each other, in accordance with the type of temperature control performed by the control unit.

2. The ink jet printing apparatus according to claim 1, wherein the plurality of detecting elements include at least a first detecting element disposed near one end in a predetermined direction of the printing element array, a second detecting element disposed near an other end in the predetermined direction of the printing element array, a third detecting element disposed between the first detecting element and the second detecting element in the predetermined direction, and near the printing element array on one end side of the printing element array in an intersecting direction that intersects the predetermined direction, a fourth detecting element disposed between the first detecting element and the second detecting element in the predetermined direction, and near the printing element array on an other end side of the printing element array in the intersecting direction, and a fifth detecting element distantly positioned from the printing element array than each of the first, second, third, and fourth detecting elements.

3. The ink jet printing apparatus according to claim 2, wherein the plurality of types of temperature control include at least a first temperature control where a first representative temperature is acquired based on temperature indicated by the predetermined combination of information pieces selected by the selecting unit, a driving pulse to apply to the plurality of printing elements is decided based on the acquired first representative temperature, and the decided driving pulse is applied to the plurality of printing elements, thereby controlling discharging of ink, and wherein, at the time of performing the first temperature control by the control unit, the selecting unit selects information pieces relating to temperatures detected by the first, second, third, and fourth detecting elements, as the predetermined combination of information pieces, without using information relating to temperature detected by the fifth detecting element.

4. The ink jet printing apparatus according to claim 3, wherein the first representative temperature is an average value of temperatures indicated by the predetermined combination of information process selected by the selecting unit.

5. The ink jet printing apparatus according to claim 3, wherein the driving pulse is made up of a pre-pulse and a main pulse, and wherein, in the first temperature control, control is effected so that a driving pulse to apply to the plurality of printing elements is determined such that a pulse width of the pre-pulse making up the driving pulse in a case where the first representative temperature that has been acquired is a first temperature, is longer than a pulse width of the of the pre-pulse making up the driving pulse in a case where the first representative temperature that has been acquired is a second temperature higher than the first temperature.

6. The ink jet printing apparatus according to claim 3, further comprising:

a scanning unit configured to scan the printing head as to a printing medium while discharging ink, and wherein, in the first temperature control, control is effected so that the first representative temperature is acquired at a predetermined timing while scanning the printing head by the scanning unit, and the driving pulse to apply to the plurality of printing elements is decided at each predetermined timing.

7. The ink jet printing apparatus according to claim 2, wherein the printing head further includes a heating element provided to cover one end side of the printing element array in the intersecting direction, to heat ink nearby the plurality of printing elements, wherein the plurality of types of temperature control include at least a second temperature control where a second representative temperature is acquired based on temperature indicated by the predetermined combination of information pieces selected by the selecting unit, and heating by the heating element is controlled based on the second representative temperature that has been acquired, and wherein, at the time of performing the second temperature control by the control unit, the selecting unit selects information pieces relating to temperatures detected by the first, second, and third detecting elements, as the predetermined combination of information pieces, without using information pieces relating to temperatures detected by the fourth and fifth detecting elements.

8. The ink jet printing apparatus according to claim 7, wherein the second representative temperature is the smallest value of the temperatures indicated by the predetermined combination of information process selected by the selecting unit.

9. The ink jet printing apparatus according to claim 7, wherein, in the second temperature control, heating is performed by the heating element in a case where the second representative temperature is lower than a first threshold value, and heating by the heating element is stopped in a case where the second representative temperature is higher than the first threshold value.

10. The ink jet printing apparatus according to claim 7, wherein, in the second temperature control, even in a case where the second representative temperature is higher than the first threshold value, heating is performed by the heating element in a case where a temperature difference between a temperature detected by the first detecting element and a temperature detected by the third detecting element, indicated by the information acquired by the acquisition, is larger than a predetermined threshold value.

11. The ink jet printing apparatus according to claim 7, further comprising:

a scanning unit configured to scan the printing head as to a printing medium while discharging ink, and wherein, in the second temperature control, the second representative temperature is acquired at a predetermined timing while scanning the printing head by the scanning unit, and the heating by the heating element is controlled at each predetermined timing.

12. The ink jet printing apparatus according to claim 2, wherein the plurality of types of temperature control include at least a third temperature control where control is effected so that a third representative temperature is acquired based on temperature indicated by the predetermined combination of information pieces selected by the selecting unit, and discharge of ink from the printing head is stopped in a case where the third representative temperature is higher than a third threshold value, and wherein, at the time of performing the third temperature control by the control unit, the selecting unit selects information pieces relating to temperatures detected by the plurality of detecting elements, as the predetermined combination of information pieces.

13. The ink jet printing apparatus according to claim 12, wherein the third representative temperature is the largest value of the temperatures indicated by the predetermined combination of information process selected by the selecting unit.

14. The ink jet printing apparatus according to claim 12, wherein, in the third temperature control, discharging of ink is continued in a case where the acquired third representative temperature is lower than the third threshold value.

15. The ink jet printing apparatus according to claim 2, wherein the plurality of types of temperature control include at least a fourth temperature control where control is effected so that a fourth representative temperature is acquired based on temperature indicated by the predetermined combination of information pieces selected by the selecting unit, and driving pulses of a level that ink is not discharged are applied to the printing elements before starting printing, until the fourth representative temperature that has been acquired reaches a fourth threshold value, and wherein, at the time of performing the fourth temperature control by the control unit, the selecting unit selects information pieces relating to temperatures detected by the first, second, third, and fourth detecting elements, as the predetermined combination of information pieces, without using information relating to temperature detected by the fifth detecting element.

16. The ink jet printing apparatus according to claim 15, wherein the fourth representative temperature is the smallest value of the temperatures indicated by the predetermined combination of information process selected by the selecting unit.

17. The ink jet printing apparatus according to claim 15, wherein the printing head further includes a heating element that is different from the plurality of printing elements, to heat ink nearby the plurality of printing elements, wherein, in the fourth temperature control, control is effected to start heating by the heating element at a first timing before starting printing, and to start applying a driving pulse to the plurality of printing elements at a second timing later than the first timing.

18. The ink jet printing apparatus according to claim 1, further comprising:

memory configured to store the plurality of information pieces acquired by the acquisition unit, wherein the selecting unit selects the predetermined combination of information pieces based on the information pieces stored in the memory.

19. The ink jet printing apparatus according to claim 3, wherein the printing head further includes a second printing element array, in which a plurality of printing elements configured to generate thermal heat to discharge ink are arrayed in a predetermined direction, and the second printing element array is adjacent to the printing element array on the other end side in the intersecting direction, wherein the fifth detecting element is disposed at a position that is between the first detecting element and the second detecting element in the predetermined direction, and that is a position near the second printing element array at the other end side of the second printing element array in the intersecting direction, wherein the plurality of types of temperature control further include a fifth temperature control where a fifth representative temperature is acquired based on temperature indicated by the predetermined combination of information pieces selected by the selecting unit, a driving pulse is decided based on the acquired fifth representative temperature, and the decided driving pulse is applied to the plurality of printing elements in the second printing element array, thereby controlling discharging of ink, and wherein, at the time of performing the fifth temperature control by the control unit, the selecting unit selects information relating to temperature detected from each of the first, second, fourth, and fifth detecting elements, as the predetermined combination of information pieces, without using information relating to temperature detected by the third detecting element, the temperature having been acquired by the acquisition unit.

20. The ink jet printing apparatus according to claim 19, wherein the printing element array and the second printing element array discharge different color ink from each other.

21. The ink jet printing apparatus according to claim 1, wherein, of the plurality of detecting elements, only the first, second, third, and fourth detecting elements are disposed near the printing element array.

22. An ink jet printing apparatus that performs printing by discharging ink, the ink jet printing apparatus comprising:

a printing head including at least a board, a printing element array disposed on the board, in which a plurality of printing elements configured to generate thermal heat to discharge ink are arrayed in a predetermined direction, and a plurality of detecting elements disposed at different positions from each other in the board, and configured to detect temperature at their respective positions;

a selecting unit configured to select a predetermined combination of detecting elements from the plurality of detecting elements;

an acquisition unit configured to acquire a plurality of information pieces relating to temperature detected from each of the detecting elements in the predetermined combination selected by the selecting unit; and a control unit configured to effect a plurality of types of temperature control relating to ink temperature nearby the printing element array, based on the information pieces acquired by the acquisition unit, wherein the selecting unit selects combinations of detecting elements that are different from each other, in accordance with the type of temperature control performed by the control unit.

23. An ink jet printing apparatus that performs printing by discharging ink, the ink jet printing apparatus comprising:

a printing head including at least a board, a printing element array disposed on the board, in which a plurality of printing elements configured to generate thermal heat to discharge ink are arrayed in a predetermined direction, a plurality of detecting elements disposed at different positions from each other in the board, and configured to detect temperature at their respective positions, and a heating element provided to cover one end side of the printing element array in an intersecting direction intersecting the predetermined direction of the printing element array, to heat ink nearby the plurality of printing elements;

an acquisition unit configured to acquire a plurality of information pieces relating to temperatures that have been detected by the plurality of detecting elements;

a selecting unit configured to select a predetermined combination of the information pieces from the plurality of information pieces acquired by the acquisition unit; and a control unit configured to effect at least two types of temperature control, out of a plurality of types of temperature relating to ink temperature including at least (i) first temperature control where a first representative temperature is acquired based on temperature indicated by the predetermined combination of information pieces selected by the selecting unit, a driving pulse to apply to the plurality of printing elements is decided based on the acquired first representative temperature, and the decided driving pulse is applied to the plurality of printing elements, thereby controlling discharging of ink, (ii) second temperature control where a second representative temperature is acquired based on temperature indicated by the predetermined combination of information pieces selected by the selecting unit, and heating by the heating element is controlled based on the second representative temperature that has been acquired, (iii) third temperature control where control is effected so that a third representative temperature is acquired based on temperature indicated by the predetermined combination of information pieces selected by the selecting unit, and discharge of ink from the printing head is stopped in a case where the third representative temperature is higher than a third threshold value, and (iv) fourth temperature control where control is effected so that a fourth representative temperature is acquired based on temperature indicated by the predetermined combination of information pieces selected by the selecting unit, and driving pulses of a level that ink is not discharged are applied to the printing elements before starting printing, until the fourth representative temperature that has been acquired reaches a fourth threshold value, wherein the plurality of detecting elements include at least a first detecting element disposed near one end in a predetermined direction of the printing element array, a second detecting element disposed near an other end in the predetermined direction of the printing element array, a third detecting element disposed between the first detecting element and the second detecting element in the predetermined direction, and near the printing element array on one end side of the printing element array in an intersecting direction that intersects the predetermined direction, a fourth detecting element disposed between the first detecting element and the second detecting element in the predetermined direction, and near the printing element array on an other end side of the printing element array in the intersecting direction, and a fifth detecting element distantly positioned from the printing element array than each of the first, second, third, and fourth detecting elements, and wherein the selecting unit (i) selects, at the time of performing the first temperature control by the control unit, information pieces relating to temperatures detected by the first, second, third, and fourth detecting elements, as the predetermined combination of information pieces, without using information relating to temperature detected by the fifth detecting element, (ii) selects, at the time of performing the second temperature control by the control unit, information pieces relating to temperatures detected by the first, second, and third detecting elements, as the predetermined combination of information pieces, without using information pieces relating to temperatures detected by the fourth and fifth detecting elements, (iii) selects, at the time of performing the third temperature control by the control unit, information pieces relating to temperatures detected by the plurality of detecting elements, as the predetermined combination of information pieces, and (iv) selects, at the time of performing the fourth temperature control by the control unit, information pieces relating to temperatures detected by the first, second, third, and fourth detecting elements, as the predetermined combination of information pieces, without using information relating to temperature detected by the fifth detecting element.

24. The ink jet printing apparatus according to claim 23, wherein the first representative temperature is an average value of temperatures indicated by the predetermined combination of information process selected by the selecting unit.

25. The ink jet printing apparatus according to claim 23, wherein the second representative temperature is the smallest value of the temperatures indicated by the predetermined combination of information process selected by the selecting unit.

26. The ink jet printing apparatus according to claim 23, wherein the third representative temperature is the largest value of the temperatures indicated by the predetermined combination of information process selected by the selecting unit.

27. The ink jet printing apparatus according to claim 23, wherein the fourth representative temperature is the smallest value of the temperatures indicated by the predetermined combination of information process selected by the selecting unit.

28. The ink jet printing apparatus according to claim 23, further comprising:

memory configured to store the plurality of information pieces acquired by the acquisition unit, wherein the selecting unit selects the predetermined combination of information pieces based on the information pieces stored in the memory.

29. The ink jet printing apparatus according to claim 23, wherein, of the plurality of detecting elements, only the first, second, third, and fourth detecting elements are disposed near the printing element array.

30. The ink jet printing apparatus according to claim 23, wherein the control unit performs all of the first, second, third, and fourth temperature control.

31. An ink jet printing method of performing printing using a printing head that includes a board, a printing element array disposed on the board, in which a plurality of printing elements configured to generate thermal heat to discharge ink are arrayed in a predetermined direction, and a plurality of detecting elements disposed at different positions from each other in the board, and configured to detect temperature at their respective positions, the method comprising:

an acquisition step to acquire a plurality of information pieces relating to temperatures that have been detected by the plurality of detecting elements;

a selecting step to select a predetermined combination of the information pieces from the plurality of information pieces acquired in the acquisition step; and a control step to effect a plurality of types of temperature control relating to ink temperature nearby the printing element array, based on the information pieces selected in the selecting step, wherein combinations of information pieces that are different from each other are selected in the selecting step, in accordance with the type of temperature control performed in the control step.

32. An ink jet printing method of performing printing using a printing head that includes a board, a printing element array disposed on the board, in which a plurality of printing elements configured to generate thermal heat to discharge ink are arrayed in a predetermined direction, a plurality of detecting elements disposed at different positions from each other in the board, and configured to detect temperature at their respective positions, and a heating element provided to cover one end side of the printing element array in an intersecting direction intersecting the predetermined direction of the printing element array, to heat ink nearby the plurality of printing elements, the method comprising:

an acquisition step to acquire a plurality of information pieces relating to temperatures that have been detected by the plurality of detecting elements;

a selecting step to select a predetermined combination of the information pieces from the plurality of information pieces acquired in the acquisition step; and a control step to effect at least two types of temperature control, out of, out of a plurality of types of temperature relating to ink temperature including at least (i) first temperature control where a first representative temperature is acquired based on temperature indicated by the predetermined combination of information pieces selected in the selecting step, a driving pulse to apply to the plurality of printing elements is decided based on the acquired first representative temperature, and the decided driving pulse is applied to the plurality of printing elements, thereby controlling discharging of ink, (ii) second temperature control where a second representative temperature is acquired based on temperature indicated by the predetermined combination of information pieces selected in the selecting step, and heating by the heating element is controlled based on the second representative temperature that has been acquired, (iii) third temperature control where control is effected so that a third representative temperature is acquired based on temperature indicated by the predetermined combination of information pieces selected in the selecting step, and discharge of ink from the printing head is stopped in a case where the third representative temperature is higher than a third threshold value, and (iv) fourth temperature control where control is effected so that a fourth representative temperature is acquired based on temperature indicated by the predetermined combination of information pieces selected in the selecting step, and driving pulses of a level that ink is not discharged are applied to the printing elements before starting printing, until the fourth representative temperature that has been acquired reaches a fourth threshold value, wherein the plurality of detecting elements include at least a first detecting element disposed near one end in a predetermined direction of the printing element array, a second detecting element disposed near an other end in the predetermined direction of the printing element array, a third detecting element disposed between the first detecting element and the second detecting element in the predetermined direction, and near the printing element array on one end side of the printing element array in an intersecting direction that intersects the predetermined direction, a fourth detecting element disposed between the first detecting element and the second detecting element in the predetermined direction, and near the printing element array on an other end side of the printing element array in the intersecting direction, and a fifth detecting element distantly positioned from the printing element array than each of the first, second, third, and fourth detecting elements, and wherein in the selecting step (i) at the time of performing the first temperature control in the control step, information relating to temperature detected from each of the first, second, third, and fourth detecting elements, is selected as the predetermined combination of information pieces, without using information relating to temperature detected by the fifth detecting element, the temperature having been acquired in the acquisition step, (ii) at the time of performing the second temperature control in the control step, information relating to temperature detected from each of the first, second, and third detecting elements, is selected as the predetermined combination of information pieces, without using information relating to temperature detected by the fourth and fifth detecting element, the temperature having been acquired in the acquisition step, (iii) at the time of performing the third temperature control in the control step, information relating to temperature detected from each of the plurality of detecting elements, is selected as the predetermined combination of information pieces, the temperature having been acquired in the acquisition step, and (iv) at the time of performing the fourth temperature control in the control step, information relating to temperature detected from each of the first, second, third, and fourth detecting elements, is selected as the predetermined combination of information pieces, without using information relating to temperature detected by the fifth detecting element, the temperature having been acquired in the acquisition step.

* * * * *